US011592208B2

(12) United States Patent
Humber et al.

(10) Patent No.: US 11,592,208 B2
(45) Date of Patent: Feb. 28, 2023

(54) WATER HEATER PAN AND HOT WATER STORAGE TANK SUPPORT SYSTEM

(71) Applicant: IPS Corporation, Collierville, TN (US)

(72) Inventors: Jeffrey A. Humber, Memphis, TN (US); Gordon L. Zeine, Jr., Bartlett, TN (US)

(73) Assignee: IPS Corporation, Collierville, TN (US)

( * ) Notice: Subject to any disclaimer, the term of this patent is extended or adjusted under 35 U.S.C. 154(b) by 0 days.

(21) Appl. No.: 16/672,911

(22) Filed: Nov. 4, 2019

(65) Prior Publication Data

US 2021/0131703 A1 May 6, 2021

(51) Int. Cl.

| | |
|---|---|
| ***F24H 9/17*** | (2022.01) |
| ***F24D 19/08*** | (2006.01) |
| ***F24H 9/06*** | (2006.01) |

(52) U.S. Cl.

CPC ..... *F24H 9/17* (2022.01); *F24D 19/088* (2013.01); *F24H 9/06* (2013.01)

(58) Field of Classification Search

CPC ..... F24H 9/165; F24H 9/06; F24H 9/17; F24D 19/088; Y10T 137/5762; Y10T 137/5835; Y10T 137/5907; B65D 19/04

See application file for complete search history.

(56) References Cited

U.S. PATENT DOCUMENTS

| | | | | |
|---|---|---|---|---|
| 7,637,387 | B1 * | 12/2009 | Cantolino | F25D 21/14 220/501 |
| 7,900,795 | B1 * | 3/2011 | Cantolino | F24F 13/222 220/608 |
| 8,100,140 | B1 * | 1/2012 | Cantolino | F24H 9/06 137/312 |
| 8,317,169 | B1 * | 11/2012 | Cantolino | F24H 9/165 267/141 |
| 2014/0027335 | A1 * | 1/2014 | Chen | B65D 1/42 206/505 |
| 2020/0003432 | A1 * | 1/2020 | Nolte | F24H 1/182 |

* cited by examiner

*Primary Examiner* — Steven S Anderson, II
(74) *Attorney, Agent, or Firm* — Womble Bond Dickinson (US) LLP

(57) ABSTRACT

The present disclosure provides a hot water storage tank support system and a water heater pan. In one implementation, the hot water tank support system comprises a water heat pan having a bottom wall, an outer wall extending upwardly from and substantially surrounding the bottom wall, and at least one elevated support feature, and at least one substantially rigid supplemental support component. The at least one elevated support feature is configured to support the hot water storage tank, and the at least one elevated support feature includes at least one supplemental support cavity configured to receive the at least one supplemental support component. In some implementations, the supplemental support component(s) may be insertable and removable from the water heater pan.

10 Claims, 20 Drawing Sheets

WATER HEATER PAN AND HOT WATER STORAGE TANK SUPPORT SYSTEM

BACKGROUND

Hot water storage tanks can be found in a variety of residential and commercial structures. As the name implies, such tanks are designed to hold and insulate and/or heat water that may be subsequently delivered to other areas of the structure through one or more plumbing lines. Most hot water storage tanks are made of a metal material, such as, for example, stainless steel, carbon steel, or copper, and many hot water storage tanks are lined with a separate material, such as, for example, an enamel material. As such, hot water storage tanks are heavy appliances, especially when full. While typical hot water storage tanks are designed for service lives of approximately 8 to 12 years, the true life expectancy of a hot water storage tank may be unknown, and thus many manufacturers recommend periodic servicing of the tank through its life. Moreover, many hot water storage tanks develop one or more leaks during the course their life cycle and, because the tanks are often located out of view of inhabitants of the structure (such as in a closet, basement, or other relatively concealed area), discovery of a leak often occurs many days after the leak first occurred. Because of this concern, most U.S. building and/or plumbing codes require a hot water storage tank be used in conjunction with a water heater pan designed to collect and contain any leakage from the storage tank. A typically water heater pan comprises a shallow open container made of a plastic or metal material configured to be installed below, and substantially surrounding, the bottom of a hot water storage tank.

Based on particular needs, hot water storage tanks are manufactured in different sizes, which are configured to accommodate different nominal water capacities and thus have different weights. It would be desirable to provide a water heater pan configured to provide increased containment capacity and that can accommodate hot water storage tanks having different weights.

BRIEF SUMMARY

The present disclosure relates to a hot water storage tank support system and a water heater pan. The present disclosure includes, without limitation, the following example implementations.

In one implementation, the present disclosure provides a hot water storage tank support system comprising a water heater pan having a bottom wall, an outer wall extending upwardly from and substantially surrounding the bottom wall, and at least one elevated support feature, and at least one substantially rigid supplemental support component. The at least one elevated support feature may be configured to contact the hot water storage tank, the at least one elevated support feature may include at least one supplemental support cavity configured to receive the at least one supplemental support component, and the at least one supplemental support component may be insertable and removable from the water heater pan. In some implementations, the at least one elevated support feature may comprise a central elevated support feature located in a central portion of the bottom wall. In some implementations, the at least one elevated support feature may comprise a circumferential elevated support feature spaced inwardly from the outer wall. In some implementations, the at least one supplemental support cavity may comprise a plurality of supplemental support cavities, the at least one supplemental support component may comprise a plurality of supplemental support components, and the plurality of supplemental support components may be insertable and removable from corresponding ones of the plurality of supplemental support cavities. In some implementations, the at least one elevated support feature may extend inwardly from the outer wall. In some implementations, the at least one supplemental support component may comprise a plurality of supplemental support components, and at least one supplemental support component may have a different size than at least one other supplemental support component.

In some implementations, the at least one supplemental support component may have a substantially tubular shape. In some implementations, the at least one supplemental support cavity may have a first width, the at least one elevated support feature may have a second width, and the first width may be larger than the second width. In some implementations, the at least one elevated support feature may comprise a pair of side walls and a top wall extending therebetween. In some implementations, the at least one elevated support feature may include at least one locating protrusion extending downward from the top surface thereof, and the at least one locating protrusion may be configured to locate the at least one supplemental support component.

In another implementation, the present disclosure provides a water heater pan configured for use with a hot water storage tank, the water heater pan comprising a bottom wall, an outer wall extending upwardly from and substantially surrounding the bottom wall, and at least one elevated support feature. The at least one elevated support feature may be configured to contact the hot water storage tank, and the at least one elevated support feature may include at least one supplemental support cavity configured to receive at least one supplemental support component. In some implementations, the at least one elevated support feature may comprise a central elevated support feature located in a central portion of the bottom wall. In some implementations, the at least one elevated support feature may comprise a circumferential elevated support feature spaced inwardly from the outer wall. In some implementations, the at least one elevated support feature may comprise a plurality of elevated support features. In some implementations, the at least one elevated support feature may extend inwardly from the outer wall.

In some implementations, the at least one supplemental support cavity may be configured to receive at least one supplemental support component having a substantially tubular shape. In some implementations, the at least one elevated support feature may include a plurality of supplemental support cavities, and the plurality of supplemental support cavities may be configured to receive a plurality of corresponding supplemental support components. In some implementations, the at least one supplemental support cavity may have a first width, the at least one elevated support feature may have a second width, and the first width may be larger than the second width. In some implementations, the at least one elevated support feature may comprise a pair of side walls and a top wall extending therebetween. In some implementations, the at least one elevated support feature may include at least one locating protrusion extending downward from the top wall thereof, and the at least one locating protrusion may be configured to locate the at least one supplemental support component.

These and other features, aspects, and advantages of the present disclosure will be apparent from a reading of the following detailed description together with the accompanying drawings, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as intended, namely to be combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying drawings which illustrate, by way of example, the principles of some described example implementations.

BRIEF DESCRIPTION OF THE DRAWING(S)

In order to assist the understanding of aspects of the disclosure, reference will now be made to the appended drawings, which are not necessarily drawn to scale and in which like reference numerals refer to like elements. The drawings are provided by way of example to assist understanding of aspects of the disclosure, and should not be construed as limiting the disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

Figure 1:
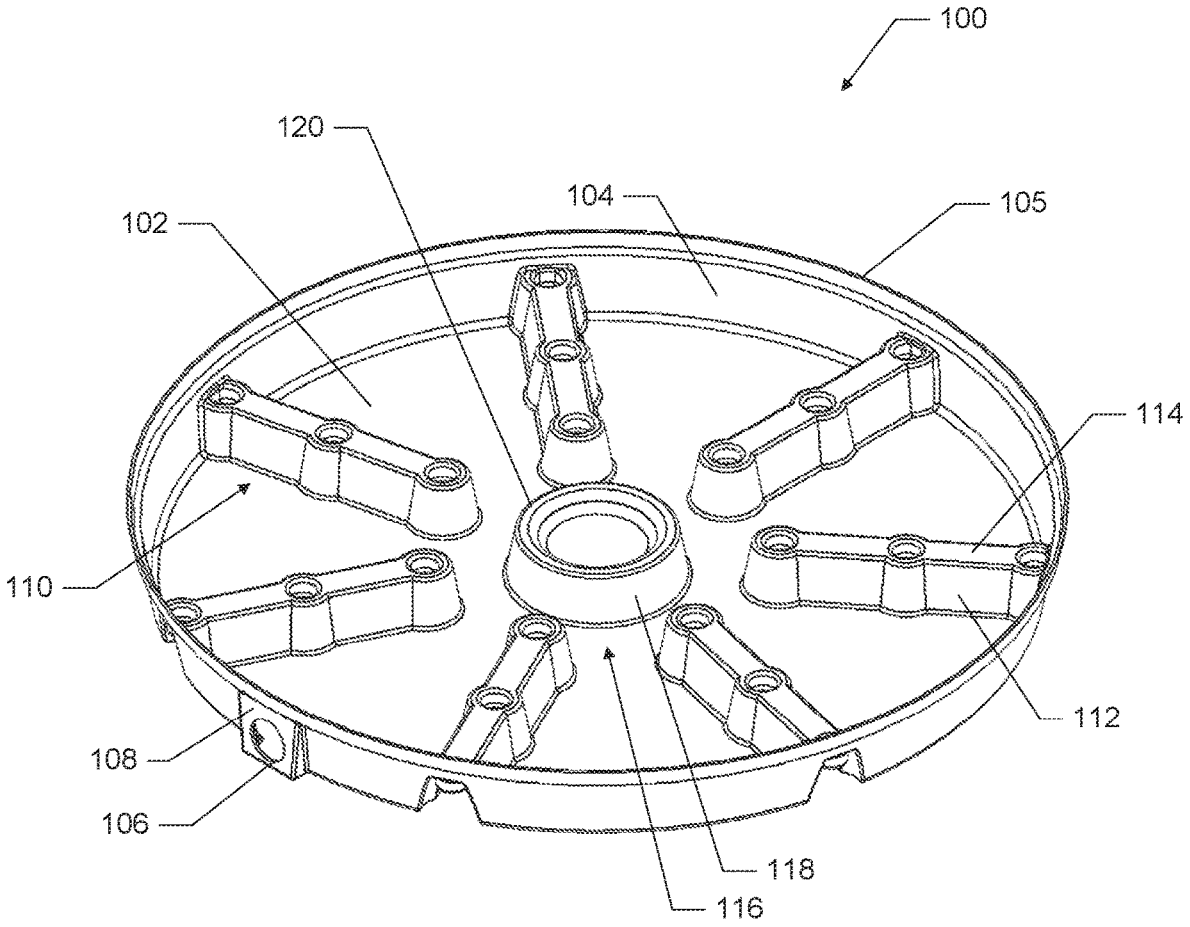
FIG. 1 is a perspective view of a water heater pan, according to an example implementation of the present disclosure.
Figure 2:
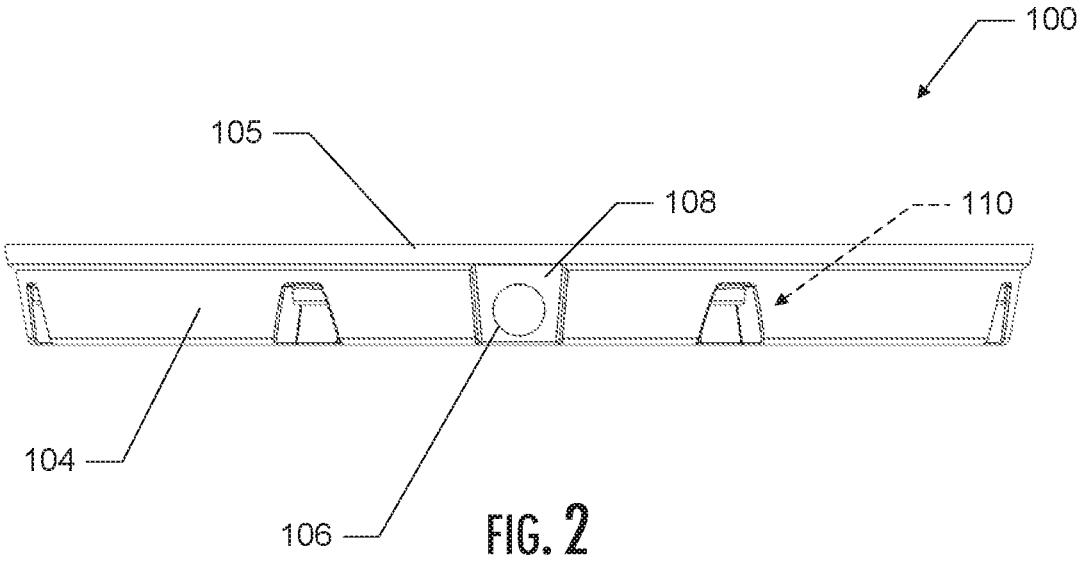
FIG. 2 illustrates a front view of a water heater pan, according to an example implementation of the present disclosure.
Figure 3:
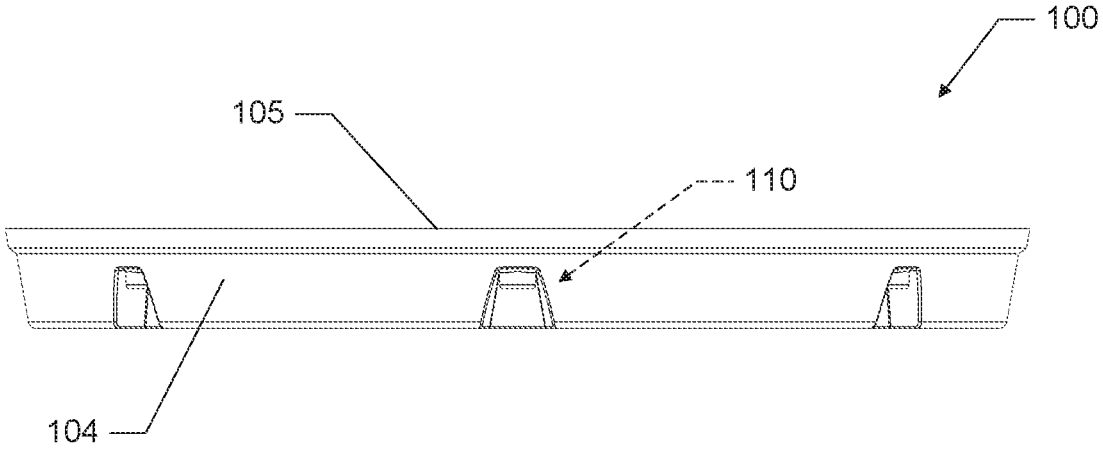
FIG. 3 illustrates a rear view of a water heater pan, according to an example implementation of the present disclosure.
Figure 4:
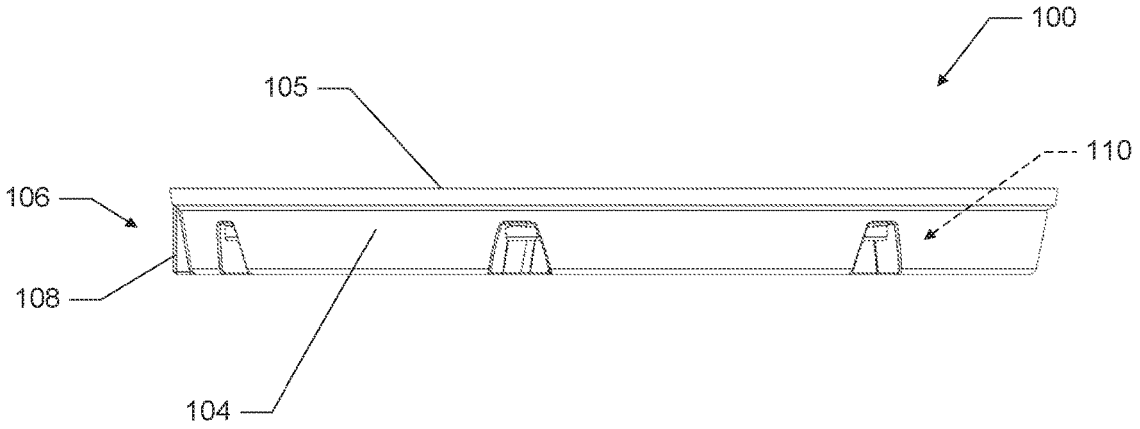
FIG. 4 illustrates a right side view of a water heater pan, according to an example implementation of the present disclosure.
Figure 5:
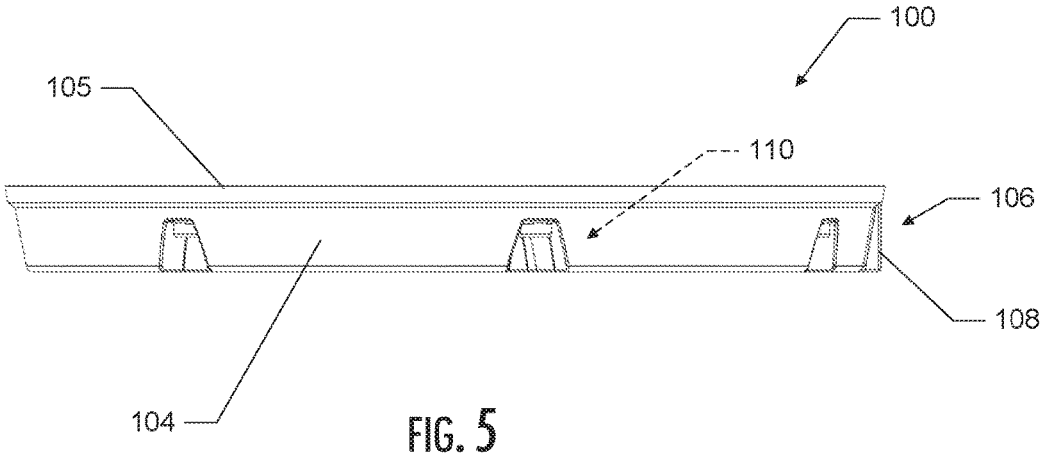
FIG. 5 illustrates a left side view of a water heater pan, according to an example implementation of the present disclosure.
Figure 6:
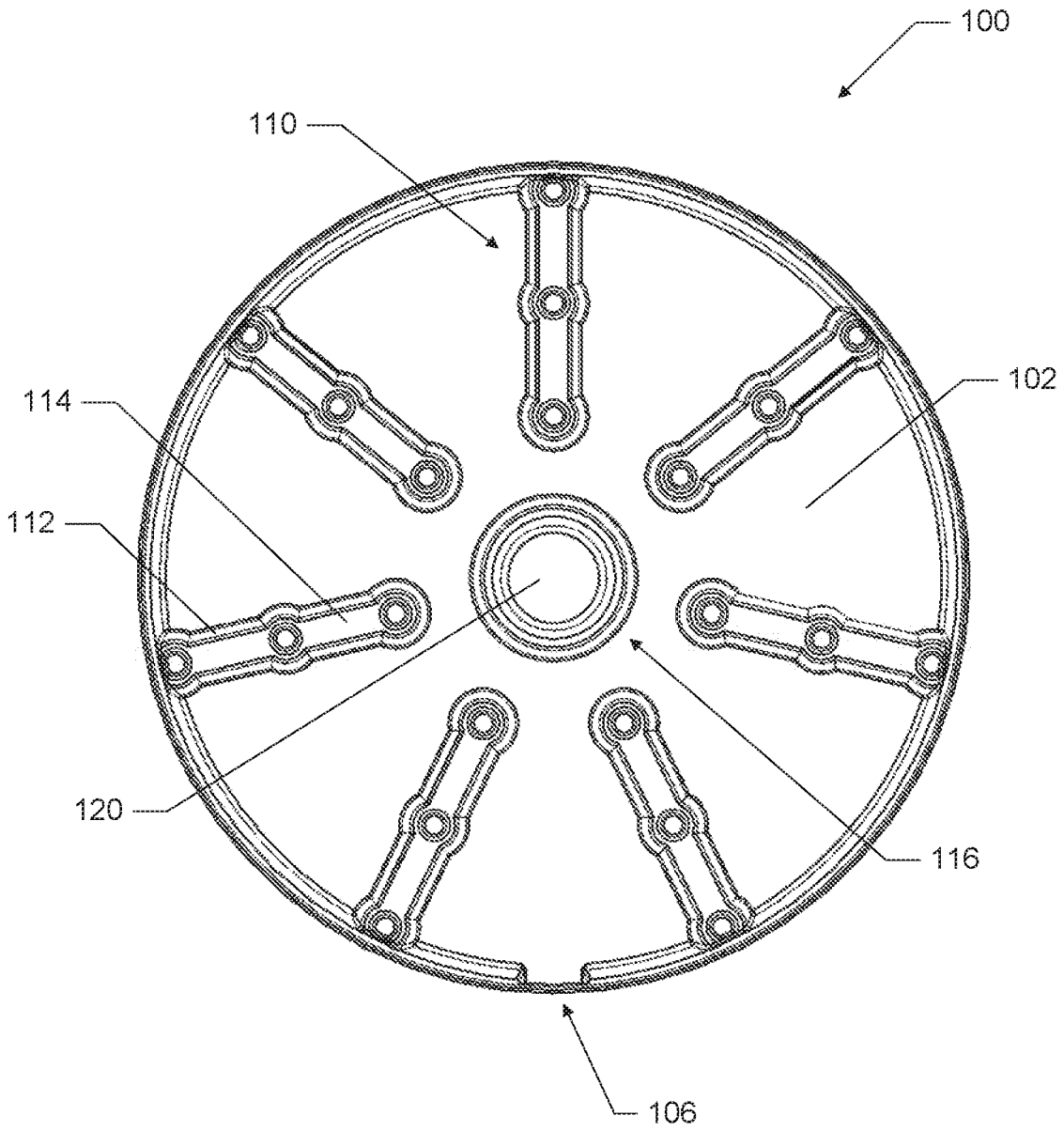
FIG. 6 illustrates a top view of a water heater pan, according to an example implementation of the present disclosure.

As described hereinafter, implementations of the present disclosure relate to water heater pans and support systems for hot water storage tanks. In particular, various implementations of water heater pans and support systems for hot water storage tanks of the present disclosure are configured to be located below, and to provide support for upright hot water storage tanks. FIG. 1 of the present disclosure illustrates a perspective view of a water heater pan 100, according to an example implementation of the present disclosure. Some of the subsequent figures illustrate various views of the water heater pan 100. In particular, FIG. 2 illustrates a front view of the water heater pan of FIG. 1; FIG. 3 illustrates a rear view of the water heater pan of FIG. 1; FIG. 4 illustrates a right side view of the water heater pan of FIG. 1, FIG. 5 illustrates a left side view of the water heater pan of FIG. 1; and FIG. 6 illustrates a top view of the water heater pan of FIG. 1. FIGS. 7-10 will be discussed in more detail further below.

With reference to FIGS. 1-6, the water heater pan 100 of the depicted implementation includes a bottom wall 102 and an outer wall 104 extending upwardly from, and substantially surrounding, the bottom wall 102. In the depicted implementation, the outer wall 104 extends upwardly from the bottom wall 102 at an obtuse angle with respect thereto. In various implementations, such a configuration may be helpful for stacking multiple water heater pans when not in use, and/or to facilitate manufacturing the pan, such as for implementations in which the pan is a unitary molded part. In other implementations, the outer wall may extend upwardly at an approximately 90 degree angle with respect to the bottom wall, or, in still other implementations, at an acute angle with respect to the bottom wall. Although not necessary in all implementations, the outer wall 104 of the depicted implementation also includes a flared lip 105 at a distal end of the outer wall 104 and extending substantially around the perimeter thereof.

In the depicted implementation, the water heater pan 100 is made of a moldable plastic material, such as, but not limited to, polycarbonate, polyethylene, acrylonitrile butadiene styrene (ABS), polyamide (Nylon), or polypropylene. Other materials are also possible, including, for example, other plastic materials such as acrylic, or metal materials such as, but not limited to, steel, aluminum, or cooper. Combinations of materials are also possible.

The outer wall also includes drain opening 106, which is defined at a location along the perimeter of the outer wall 104, and which may be configured for attachment of a hose or other conduit for draining any water contained in the pan 100. Although in the depicted implementation, the drain opening 106 is substantially circular in shape and is defined in an extended area 108 of the outer wall 104 that is substantially perpendicular to the bottom wall 102, in other implementations the drain opening may have other configurations.

In various implementations, the water heater pan of the present disclosure may include at least one elevated support feature configured to position the bottom of a hot water storage tank above the surface of the bottom wall of the pan. In such a manner, the water heater pan of the present disclosure may provide additional volume for water to accumulate that would otherwise be taken up by the bottom of a hot water storage tank. In the depicted implementation, the water heater pan 100 includes a plurality of elevated support features 110, which are configured to support the bottom of a hot water storage tank. Although elevated support features of various implementations may have any shape, in the depicted implementation the elevated support features 110 comprise substantially linear elongate structures that extend radially from the outer wall 104 toward a center portion of the bottom wall 102. Although in other implementations the elevated support features may have other arrangements, in the depicted implementation the elevated support features 110 intersect the outer wall 104 on one end, with each of the elevated support features 110 comprising a pair of side walls 112 and a top wall 114 extending therebetween. The side walls 112 of the depicted implementation extend upwardly from the bottom wall 102 at an obtuse angle with respect to the bottom wall 102. In various implementations, such a configuration may be helpful for stacking multiple water heater pans when not in use, and/or to facilitate manufacturing the pan, such as for implementations in which the pan is a unitary molded part. However, in other implementations, the outer wall may extend upwardly at an approximately 90 degree angle with respect to the bottom wall, or, in other implementations, at an acute angle with respect to the bottom wall. In the depicted implementation, the side walls 112 of each of the elevated support features 110 begin at the outer wall 104 and converge at a front portion of the elevated support feature 110. In such a manner, each of the elevated support features 110 of the depicted implementation creates a relatively hollow area therein. In the depicted implementation, there are seven elevated support features 110; however, in other implementations there may be more or less elevated support features. For example, in some implementations there may be as few as three (or less) elevated support features, while in other implementations, there may be eight, nine, ten, eleven, twelve, or more elevated support features. In the depicted implementation, the elevated support features 110 have a height that is slightly larger than half of the overall height of the outer wall 104 of the pan (such as, e.g., $5/8^{th}$ of the overall height of the outer wall); however, in other implementations the elevated support features may have any height, which may be less than, substantially equal to, or greater than the height of the outer wall. Although in the depicted implementation the elevated support features 110 are substantially evenly spaced around the perimeter of the outer wall 104, in other implementations the elevated support features need not be evenly spaced and may have an uneven arrangement. Furthermore, although in the depicted implementation the elevated support features 110 have a particular shape, including a length, width, and height thereof, in other implementations the elevated support features may have varying shapes, even within the same water heater pan.

The depicted implementation of the water heater pan 100 also includes a central elevated support feature 116, which is located in the central portion of the bottom wall 102. In the depicted implementation, the central elevated support feature 116 comprises a side wall 118, which extends upwardly from the bottom wall 102, and top wall 120 that together form a substantially hollow area therein. In the depicted implementation, the side wall 118 extends upwardly from the bottom wall 102 at an obtuse angle with respect to the bottom wall 104. In various implementations, such a configuration may be helpful for stacking multiple water heater pans when not in use, and/or to facilitate manufacturing the pan, such as for implementations in which the pan is a unitary molded part. However, in other implementations, the side wall may extend upwardly at an approximately 90 degree angle with respect to the bottom wall, or, in other implementations, at an acute angle with respect to the bottom wall. Although in the depicted implementation the central elevated support feature 116 has truncated conical overall shape, in other implementations the central elevated support feature may have any shape. It should be noted that some implementations need not include a central elevated support feature. In the depicted implementation, the central elevated support feature 116 has a height that is slightly larger than half of the overall height of the outer wall 104 of the pan (such as, e.g., $5/8^{th}$ of the overall height of the outer wall) and that substantially matches the height of the other elevated support features 110; however, in other implementations the central elevated support feature may have different dimensions.

As described above, hot water storage tanks come in various shapes and sizes. When full, some hot water heater storage tanks weigh in excess of 500 lbs. As such, in addition to the support provided by the elevated support features, the water heater pan of the present disclosure also includes one or more features configured to accommodate one or more supplemental support components. In particular, the water heater pan 100 of the present disclosure includes at least one supplemental support cavity configured to receive a supplemental support component.

Figure 7:
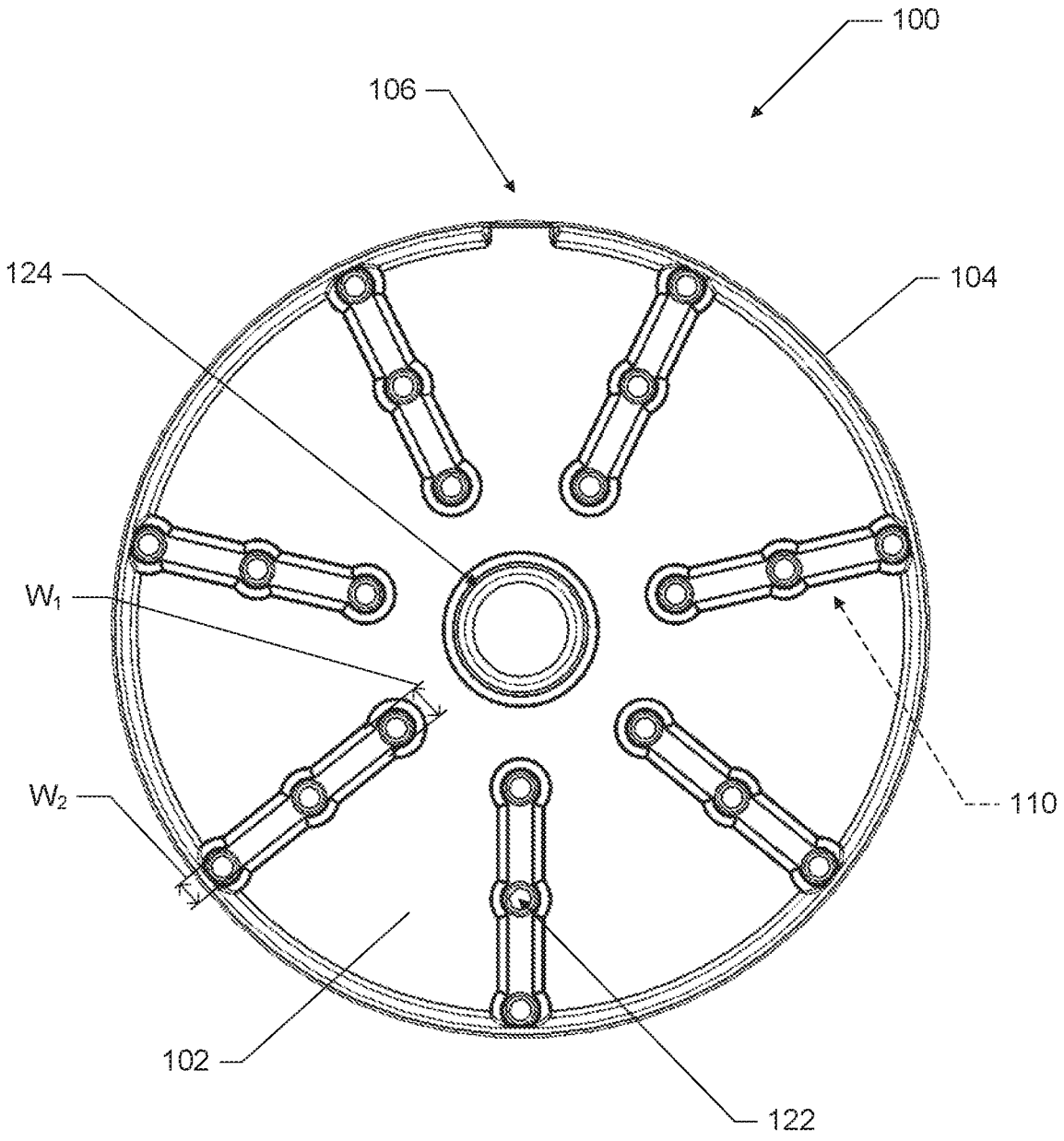
FIG. 7 illustrates a bottom view of a water heater pan, according to an example implementation of the present disclosure.
Figure 8:
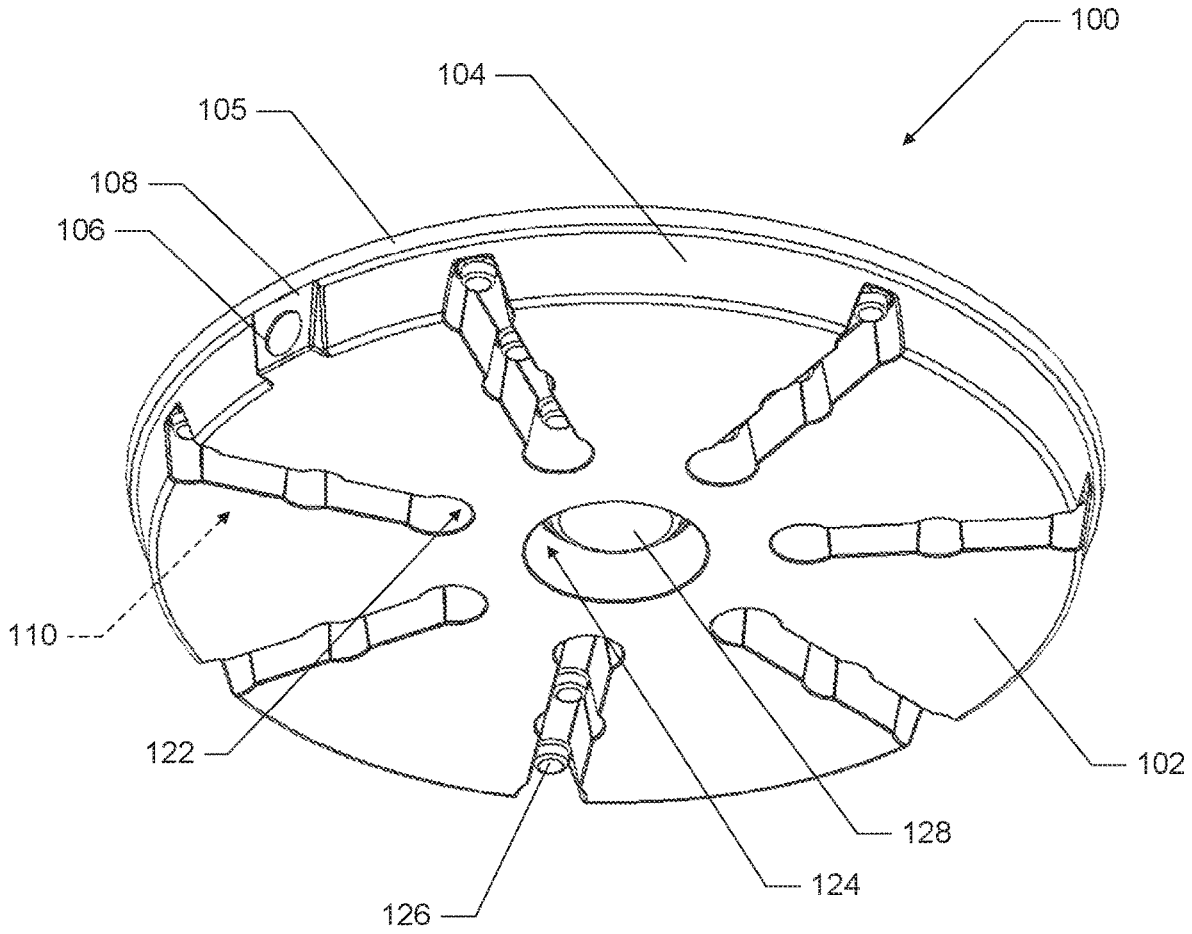
FIG. 8 illustrates a reverse perspective view of a water heater pan, according to an example implementation of the present disclosure.

FIG. 7 illustrates a bottom view of the water heater pan 100, according to an example implementation of the present disclosure, and FIG. 8 illustrates a reverse perspective view of the water heater pan 100, showing the bottom side thereof. With reference to the figures, at least one of the elevated support features 110 of the water heater pan 100 of the depicted implementation includes a supplemental support cavity 122 configured to receive a supplemental support component. Although in other implementations the elevated support features may include more or less supplemental support cavities, in the depicted implementation each of the elevated support features 110 includes a plurality of supplemental support cavities 122. In the case of the depicted implementation, each elevated support feature 110 includes three supplemental support cavities 122. It should be noted, however, that in other implementations, not all of the elevated support features need include a supplemental support cavity.

In the depicted implementation, the supplemental support cavities 122 of the elevated support features 110 are substantially evenly spaced along a length of the elevated support features 110, such that one supplemental support cavity 122 is located proximate the outer wall 104, another supplemental support cavity 122 is located proximate a distal end of the elevated support feature 110, and a third supplemental support cavity 122 is located approximately halfway between the first and second supplemental support cavities 122. It should be noted, however, that in other implementations, the supplemental support cavities may have different locations within the elevated support features and need not be evenly spaced. In the depicted implementation, the central elevated support feature 116 also includes a supplemental support cavity 124.

In the depicted implementation, the supplemental support cavities 122 of the elevated support features 110, 116 have a truncated conical shape configured to receive a tubular shaped supplemental support component (described in more detail below). The supplemental support cavities 122 of the elevated support features 110 of the depicted implementation also have a width ($W_1$) that is larger than a width ($W_2$) defined between the pair of side walls 112 of the elevated support features 110. (Note that in various implementations, $W_1$ and $W_2$ may be measured at various corresponding locations.) In such a manner, the supplemental support features 122 of the elevated support features 110 of the depicted implementation may trap or substantially retain supplemental support components contained therein. It should be noted, however, in other implementations the supplemental support cavities may have any shape and may be configured to receive a supplemental support component having any shape. Moreover, in still other implementations the supplemental support cavities may have different shapes within the same water heater pan.

In addition to the configuration of the supplemental support cavities (as in the case of the depicted implementation) or as alternative thereto (as in the case of other implementations), the elevated support features may further include location protrusions. For example, the elevated support features 110, 116 of the depicted implementation further include corresponding location protrusions 126, 128 that extend downward from the respective top walls 114, 120 thereof. In the depicted implementation, the location protrusions 126, 128 extend downward a distance less than the distance to the bottom of the bottom wall 102; however, in other implementations the location protrusions may extend any distance up to and including the distance to the bottom of the bottom wall. Further, in some implementations the location protrusions may extend different distances, even within the same water heater pan. It should be noted that while not all implementations need include any location protrusions and not all elevated support features need include location protrusions therein, in the depicted implementation there are twenty-two location protrusions 126, 128 (twenty-one location protrusions 126 located in the elevated support features 110 and one location protrusion 128 located in the central elevated support feature 116). These protrusions correspond to the twenty-one supplemental support cavities 122 defined by the elevated support features 110 and the support cavity 124 defined by the central elevated support feature 116.

Figure 9A:
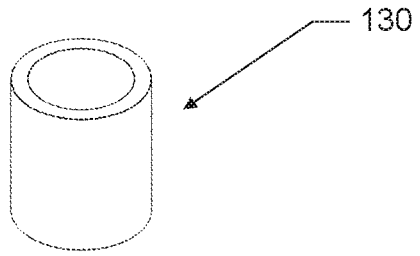
FIG. 9A illustrates a first supplemental support component of a water storage tank support system, according to an example implementation of the present disclosure.
Figure 9B:
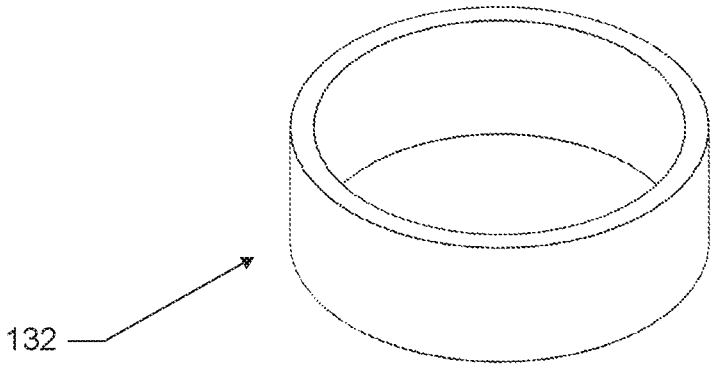
FIG. 9B illustrates a second supplemental support component of a water storage tank support system, according to an example implementation of the present disclosure.

As noted above, the water heater pan of the present disclosure includes one or more features configured to accommodate one or more supplemental support components. In the case of the depicted implementation, for example, the water heater pan 100 includes supplemental support cavities 122, 124 that are configured to accommodate two different supplemental support components. FIG. 9A illustrates a first supplemental support component of a water storage tank support system, according to an example implementation of the present disclosure; and FIG. 9B illustrates a second supplemental support component of a water storage tank support system, according to an example implementation of the present disclosure. In particular, FIG. 9A illustrates a first supplemental support component 130, which is configured to be received in the supplemental support cavities 122 defined by the elevated support features 110. FIG. 9B illustrates a second supplemental support component 132, which is configured to be received in the central supplemental support cavity 124 defined by the central elevated support feature 116. As noted above, in the depicted implementation the supplemental support components 130, 132 comprise tubular structures, such as, for example, tubular structures that may be cut from standard pipes (e.g., standard PVC plumbing pipes). For example, in the depicted implementation, the first supplemental support component 130 may comprise a portion (such as, for example, an approximately 1.5 inch length section) of a standard 1 inch outside diameter PVC pipe, and the second supplemental support component 132 may comprise a portion (such as, for example, an approximately 1.5 inch length section) of a standard 4" outside diameter PVC pipe. It should be noted, however, that in other implementations the dimensions of the first and second supplemental support components may vary, and need not correspond to standard pipe elements.

In other implementations, one or more supplemental support components may be made of a different material such as, for example, other plastic materials such as polycarbonate, polyethylene, acrylonitrile butadiene styrene (ABS), polyamide (Nylon), polypropylene, or acrylic. Still other material are also possible, including, for example, metal materials such as, but not limited to, steel, aluminum, or copper, as well as other non-metal materials such as wood, and/or composite materials. Combinations of materials are also possible.

Figure 10:
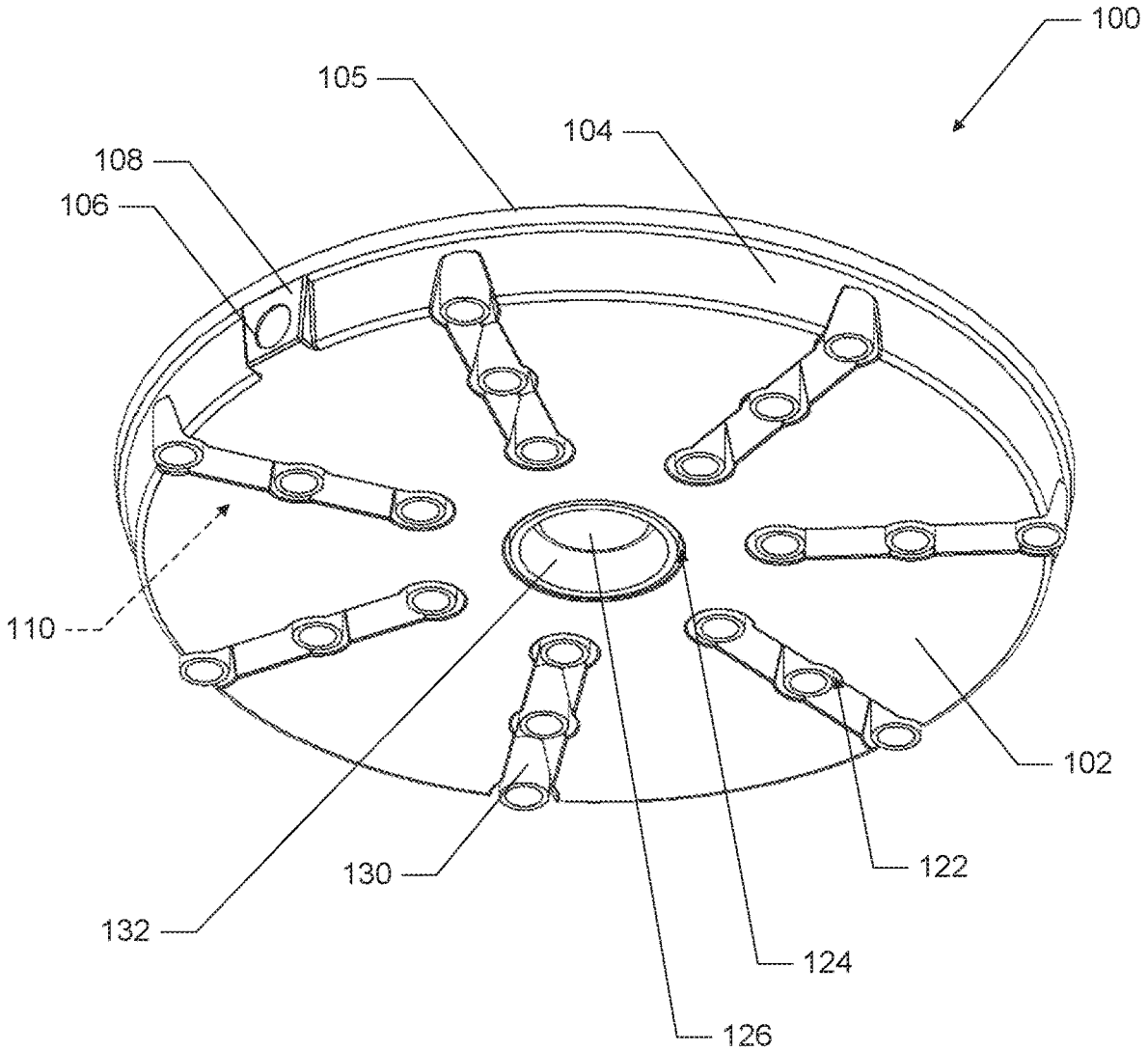
FIG. 10 illustrates a reverse perspective view of a water storage tank support system, according to an example implementation of the present disclosure.
Figure 11:
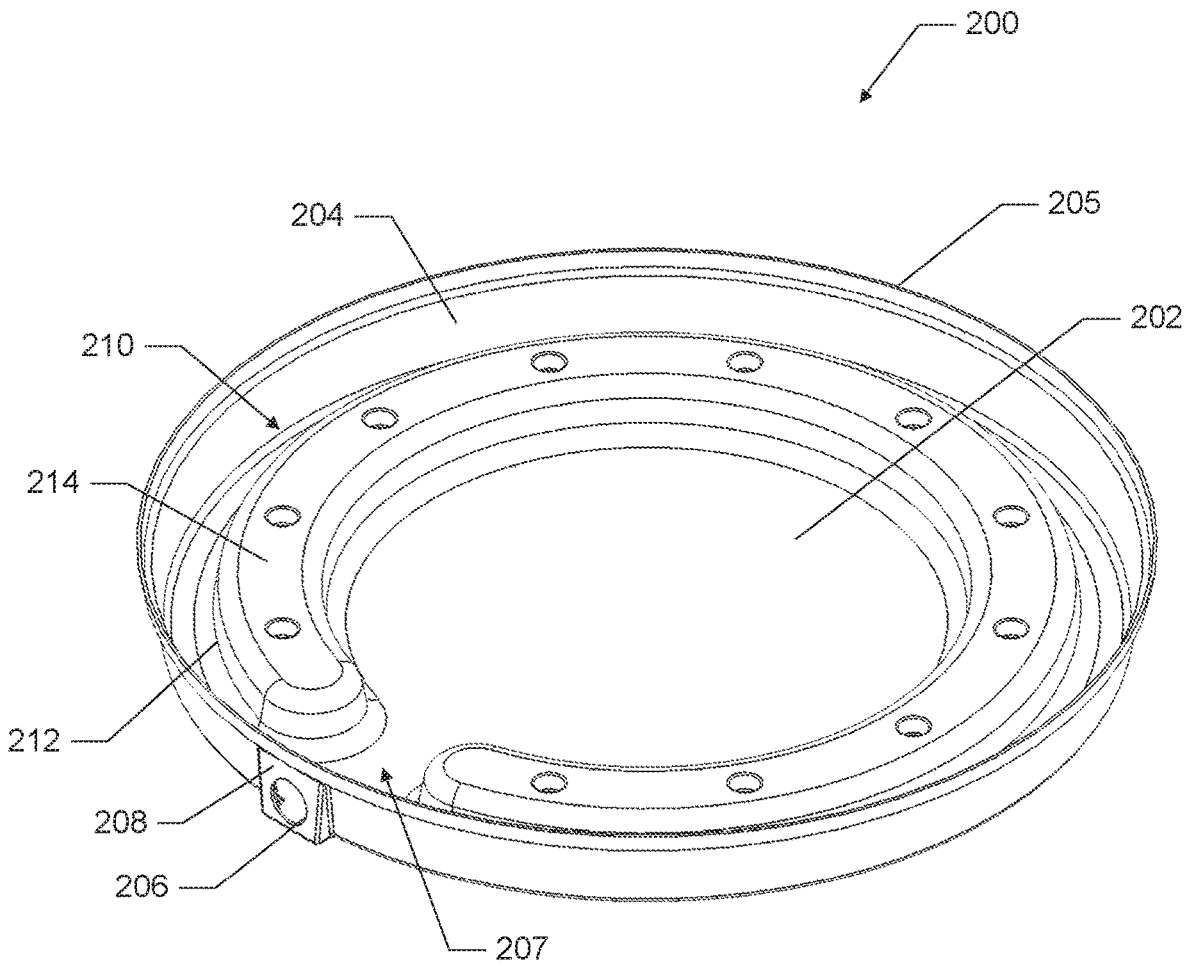
FIG. 11 is a perspective view of a water heater pan, according to an example implementation of the present disclosure.

In various implementations, the present disclosure also provides a water storage tank support system that comprises a water heater pan and one or more supplemental support components. FIG. 10 illustrates a reverse perspective view of a water storage tank support system, according to an example implementation of the present disclosure. In particular, FIG. 10 illustrates a hot water storage tank support system 134 that comprises a water heater pan 100 having seven elevated support features 110, and a plurality of supplemental support components 130, 132. More particularly, the water storage support system 134 of the depicted implementation includes a heater pan 100 having seven elevated support features 110, each with three supplemental support cavities 122 that contain first supplemental support components 130 therein. In addition, the water heater pan 100 of the water storage support system 134 of the depicted implementation further includes a central elevated support feature 116, which includes a second supplemental support component 132 contained therein.

As noted above, in other implementations a supplemental support system may include more or less elevated support features, some of which may, or may not, include supplemental support components. For example, a hot water storage tank support system of one implementation may include only one supplemental support component (which, in some implementations, may be located in a central supplemental support cavity). While other implementations may differ, in the depicted implementation the supplemental support components 130, 132 are configured to be insertable and removable from the water heater pan 100. In such a manner, an installer of the system of the depicted implementation, who may have access to standard plumbing pipes (such as, for example, standard PVC plumbing pipes), may create a hot water storage tank support system by installing one or more supplemental support components cut from the standard plumbing pipes into one or more of the supplemental support cavities of the water heater pan. In various implementations, the number of support components (if any are used at all) may be determined on an application by application basis. For example, in some applications a hot water storage tank (such as, for example, a small hot water storage tank) need only require a support system that includes one supplemental support component, while in other applications a hot water storage tank (such as, for example, a large hot water storage tank) may require a larger number of supplemental support components. Thus, for implementations where the supplemental support components can be created from standard plumbing pipes, an installer may cut as few or as many as needed for that application.

Figure 12:
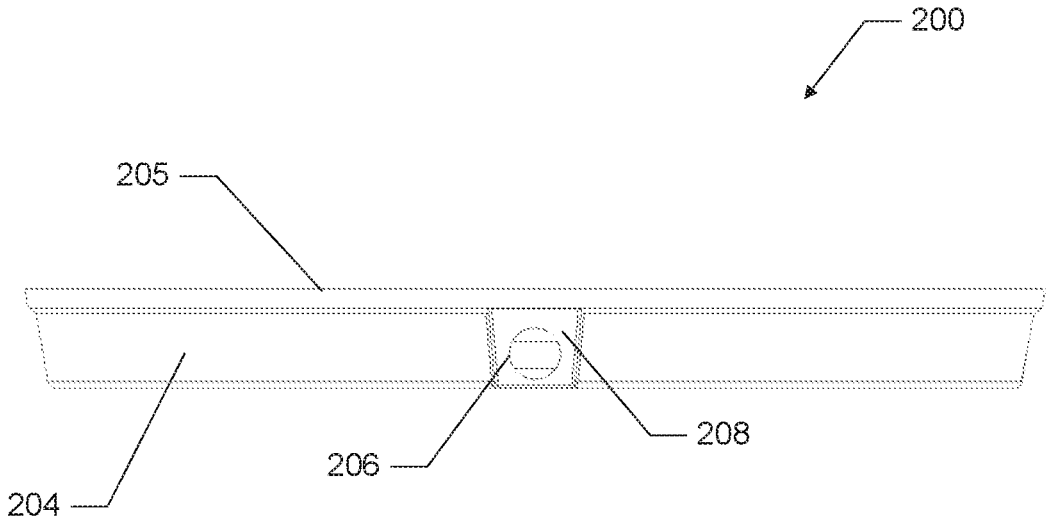
FIG. 12 illustrates a front view of a water heater pan, according to an example implementation of the present disclosure.
Figure 13:
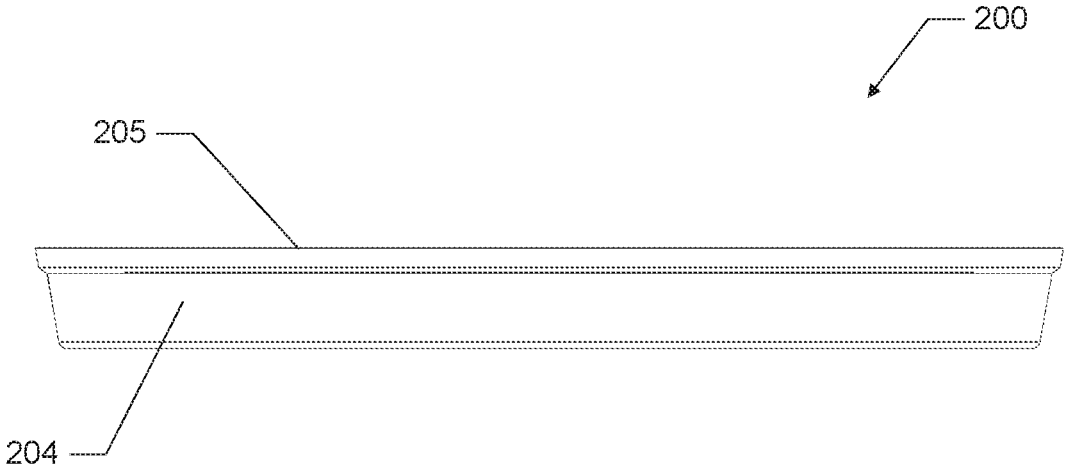
FIG. 13 illustrates a rear view of a water heater pan, according to an example implementation of the present disclosure.
Figure 14:
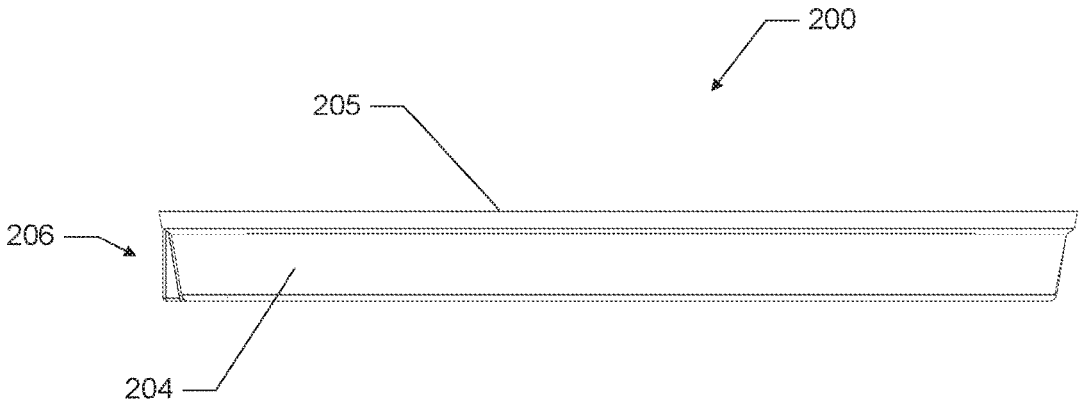
FIG. 14 illustrates a right side view of a water heater pan, according to an example implementation of the present disclosure.
Figure 15:
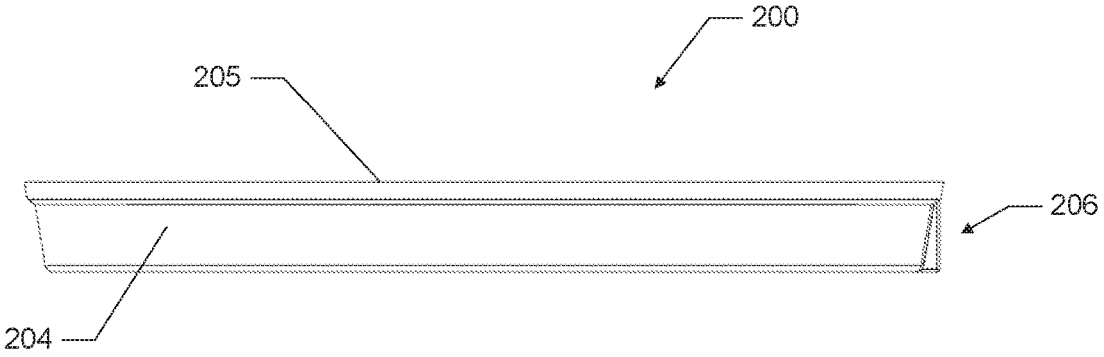
FIG. 15 illustrates a left side view of a water heater pan, according to an example implementation of the present disclosure.
Figure 16:
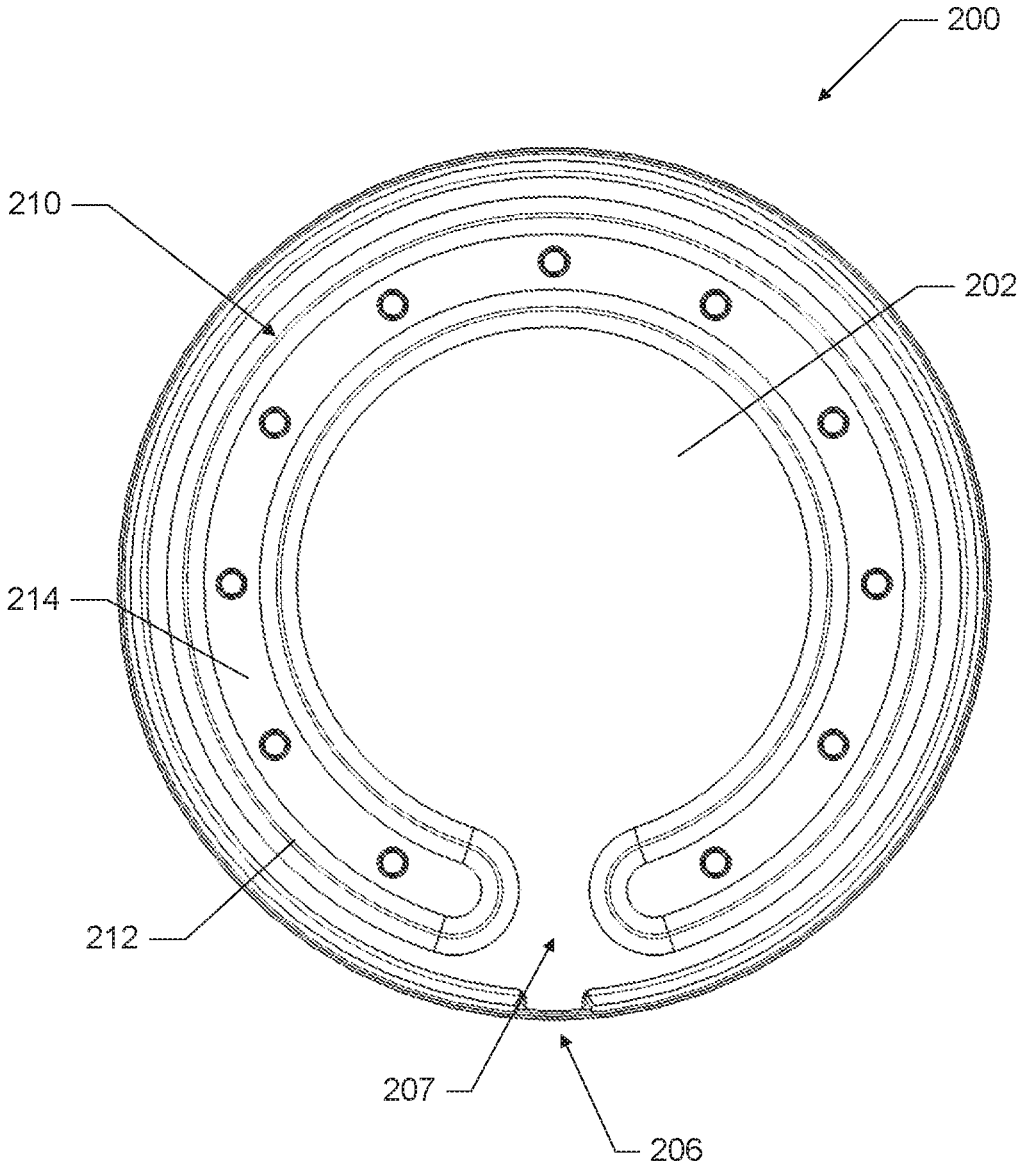
FIG. 16 illustrates a top view of a water heater pan, according to an example implementation of the present disclosure.
Figure 17:
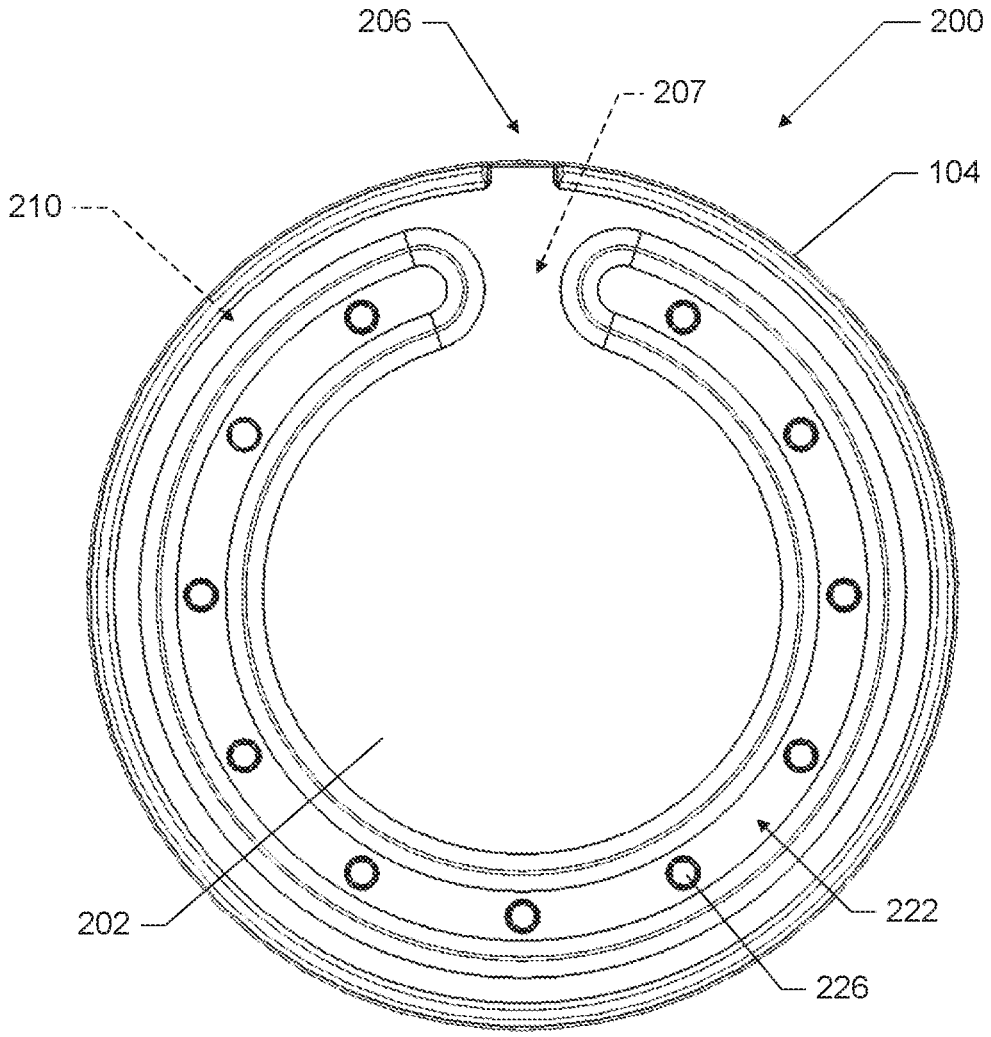
FIG. 17 illustrates a bottom view of a water heater pan, according to an example implementation of the present disclosure.
Figure 18:
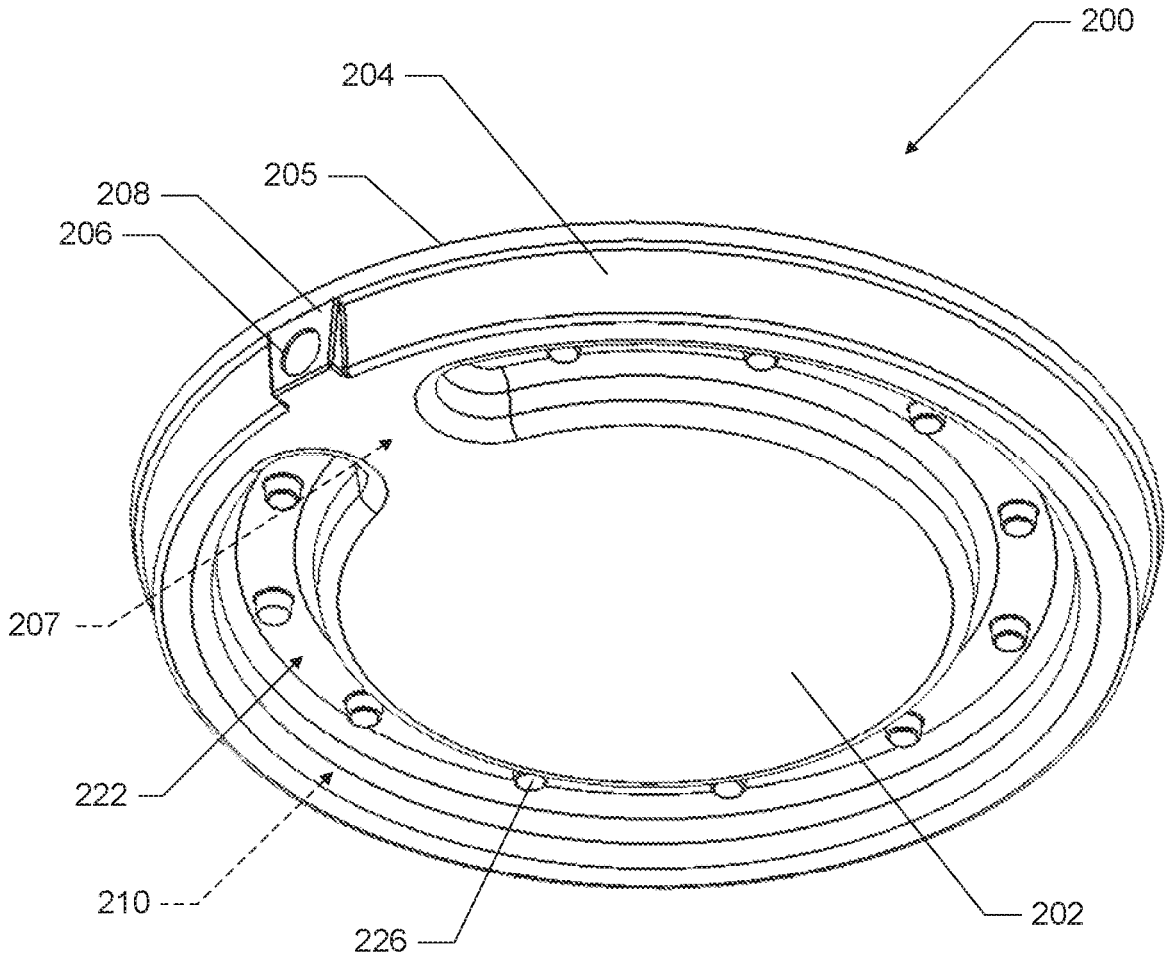
FIG. 18 illustrates a reverse perspective view of a water heater pan, according to an example implementation of the present disclosure.
Figure 19:
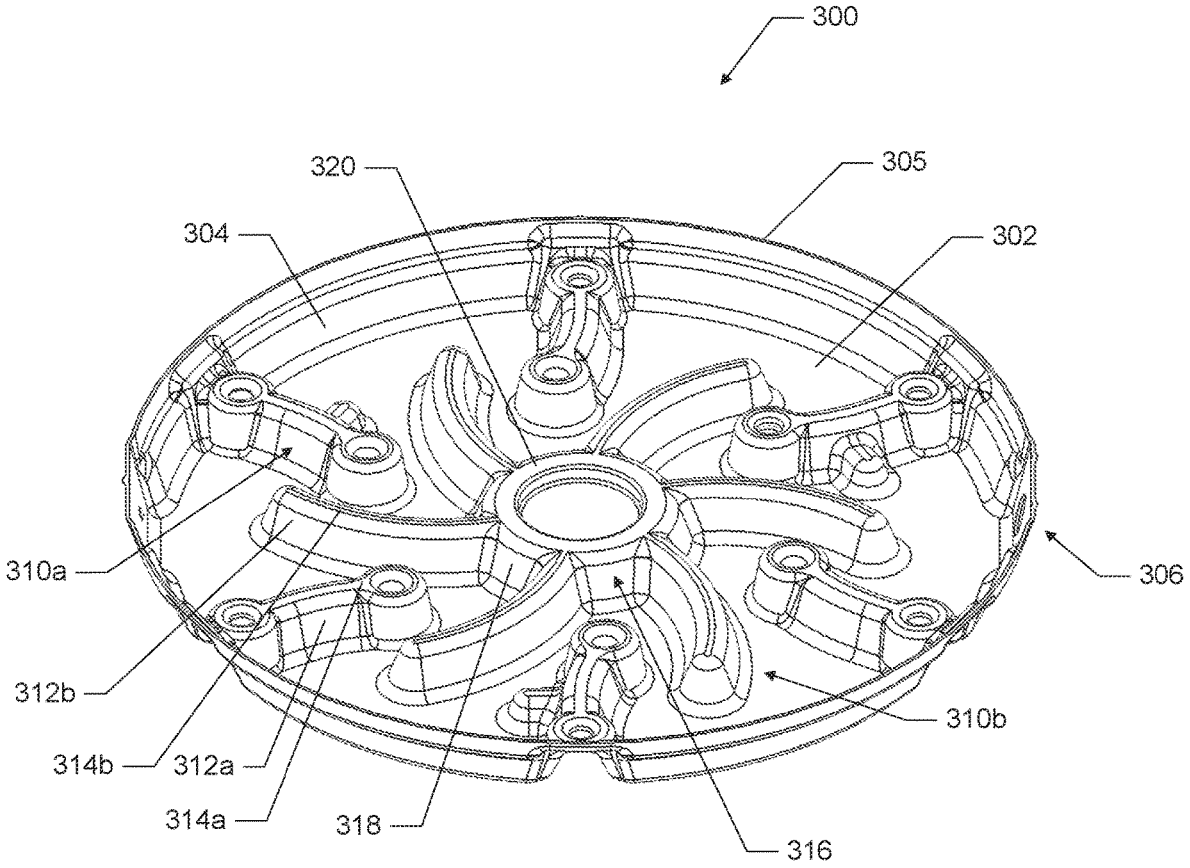
FIG. 19 is a perspective view of a water heater pan, according to an example implementation of the present disclosure.

FIGS. 11-18 illustrate another implementation of the present disclosure. In particular, FIG. 11 of the present disclosure illustrates a perspective view of a water heater pan 200, according to an example implementation of the present disclosure; FIG. 12 illustrates a front view of the water heater pan 200; FIG. 13 illustrates a rear view of the water heater pan 200; FIG. 14 illustrates a right side view of the water heater pan 200; FIG. 15 illustrates a left side view of the water heater pan 200; FIG. 16 illustrates a top view of the water heater pan 200; FIG. 17 illustrates a bottom view of the water heater pan 200; and FIG. 18 illustrates a reverse perspective view of a water heater pan.

With reference to the figures, the water heater pan 200 of the depicted implementation includes a bottom wall 202 and an outer wall 204 extending upwardly from, and substantially surrounding, the bottom wall 202. In the depicted implementation, the outer wall 204 extends upwardly from the bottom wall 202 at an obtuse angle with respect thereto. In various implementations, such a configuration may be helpful for stacking multiple water heater pans when not in use, and/or to facilitate manufacturing the pan, such as for implementations in which the pan is a unitary molded part. In other implementations, the outer wall may extend upwardly at an approximately 90 degree angle with respect to the bottom wall, or, in still other implementations, at an acute angle with respect to the bottom wall. Although not necessary in all implementations, the outer wall 204 of the depicted implementation also includes a flared lip 205 at a distal end of the outer wall 204 and extending substantially around the perimeter thereof.

In the depicted implementation, the water heater pan 200 is made of a moldable plastic material, such as, but not limited to, polycarbonate, polyethylene, acrylonitrile butadiene styrene (ABS), polyamide (Nylon), or polypropylene. Other materials are also possible, including, for example, other plastic materials such as acrylic, or metal materials such as, but not limited to, steel, aluminum, or cooper. Combinations of materials are also possible.

The outer wall also includes drain opening 206, which is defined at a location along the perimeter of the outer wall 204, and which may be configured for attachment of a hose or other conduit for draining any water contained in the pan 200. Although in the depicted implementation the drain opening 206 is substantially circular in shape and is defined in an extended area 208 of the outer wall 204 that is substantially perpendicular to the bottom wall 202, in other implementations the drain opening may have other configurations.

In various implementations, the water heater pan of the present disclosure may include at least one elevated support feature configured to position the bottom of a hot water storage tank above the surface of the bottom wall of the pan. In such a manner, the water heater pan of the present disclosure may provide additional volume for water to accumulate that would otherwise be taken up by the bottom of a hot water storage tank. In the depicted implementation, the water heater pan 200 includes a single elevated support feature 210, which is configured to support the bottom of a hot water storage tank. Although elevated support features of various implementations may have any shape, in the depicted implementation the elevated support feature 210 comprises a circumferential elevated support feature that is substantially evenly spaced inwardly from the outer wall 204. In the depicted implementation, the circumferential elevated support feature 210 includes a gate feature 207, which comprises a break in the circumferential elevated support feature 210 and is configured to allow any collected water to reach the drain opening 206. In the depicted implementation, the gate feature 207 is located proximate the drain opening 206. In other implementations, however, there may be multiple gate features, which may or may not, be positioned proximate the drain opening. In still other implementations, there need not be a gate feature. In the depicted implementation, the elevated support feature 210 comprises a pair of side walls 212 and a top wall 214 extending therebetween. The side walls 212 of the depicted implementation extend upwardly from the bottom wall 202 at an obtuse angle with respect to the bottom wall 202. In various implementations, such a configuration may be helpful for stacking multiple water heater pans when not in use, and/or to facilitate manufacturing the pan, such as for implementations in which the pan is a unitary molded part. However, in other implementations, the outer wall may extend upwardly at an approximately 90 degree angle with respect to the bottom wall, or, in other implementations, at an acute angle with respect to the bottom wall. In the depicted implementation, the side walls 212 of the elevated support feature 210 converge proximate the gate feature 207. In such a manner, the elevated support feature 210 of the depicted implementation creates a relatively hollow area therein. In the depicted implementation, the elevated support features 210 has a height that is slightly larger than half of the overall height of the outer wall 204 of the pan (such as, e.g., $5/8^{th}$ of the overall height of the outer wall); however, in other implementations the elevated support feature may have any height, which may be less than, substantially equal to, or greater than the height of the outer wall. It should be noted that although in the depicted implementation the elevated support features 210 has a particular shape, including a length, width, and height thereof, in other implementations one or more elevated support features may have varying shapes, even within the same water heater pan.

In various implementations, an elevated support feature of the present disclosure may include one or more supplemental support cavities. With reference to FIGS. 17 and 18, the elevated support feature 210 of the water heater pan 200 of the depicted implementation includes a single supplemental support cavity 222, which is configured to receive a plurality of supplemental support components. In the depicted implementation, the elevated support feature 210 further includes a plurality of location protrusions 226 that extend downward from the top wall 214 thereof. Although in other implementations an elevated support feature may include more or less location protrusions, in the depicted implementation the elevated support feature 210 includes eleven location protrusions 226, which are substantially evenly spaced around the circumferential length of the elevated support feature 210. It should be noted, however, that in other implementations, the location protrusions may have different locations within the elevated support feature and need not be evenly spaced. In the depicted implementation, the location protrusions 226 of the elevated support feature 210 have truncated conical shapes. As such, the plurality of location protrusions are configured to receive tubular shaped supplemental support components (as described, for example, above). It should be noted, however, in other implementations the location protrusions may have any shape and may be configured to receive supplemental support components having any shape. Moreover, in still other implementations the location protrusions may have different shapes within the same water heater pan.

In the depicted implementation, the location protrusions 226 extend downward a distance less than the distance to the bottom of the bottom wall 202; however, in other implementations the location protrusions may extend any distance up to and including the distance to the bottom of the bottom wall. Further, in some implementations the location protrusions may extend different distances, even within the same water heater pan. It should be noted that not all implementations need include any location protrusions and not all elevated support features need include location protrusions therein.

Figure 20:
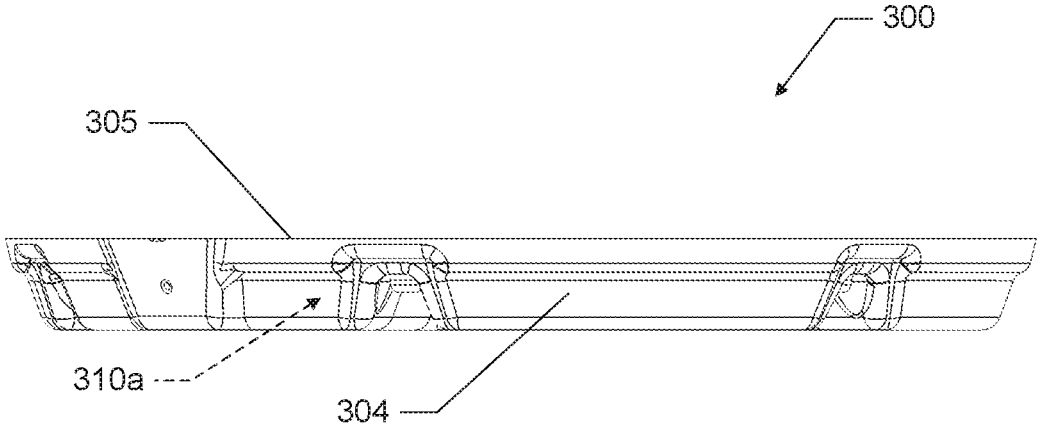
FIG. 20 illustrates a front view of a water heater pan, according to an example implementation of the present disclosure.
Figure 21:
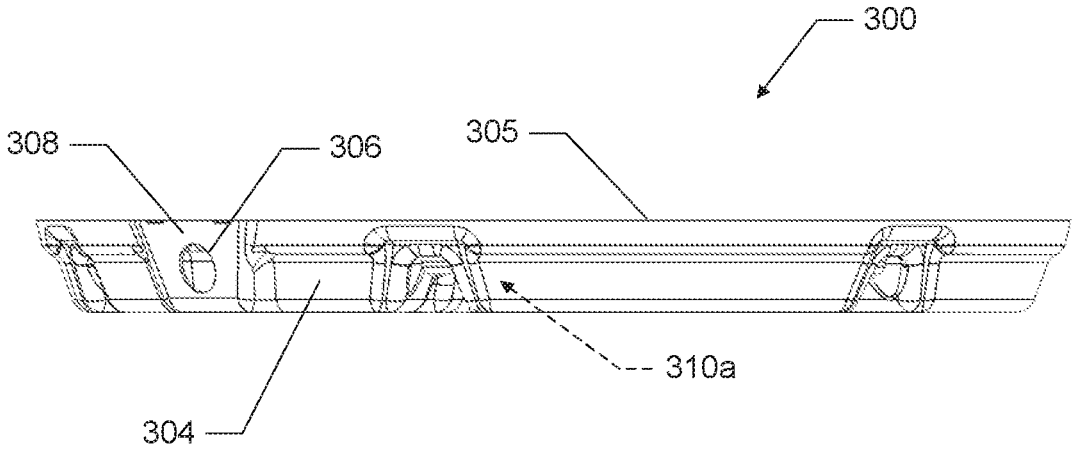
FIG. 21 illustrates a rear view of a water heater pan, according to an example implementation of the present disclosure.
Figure 22:
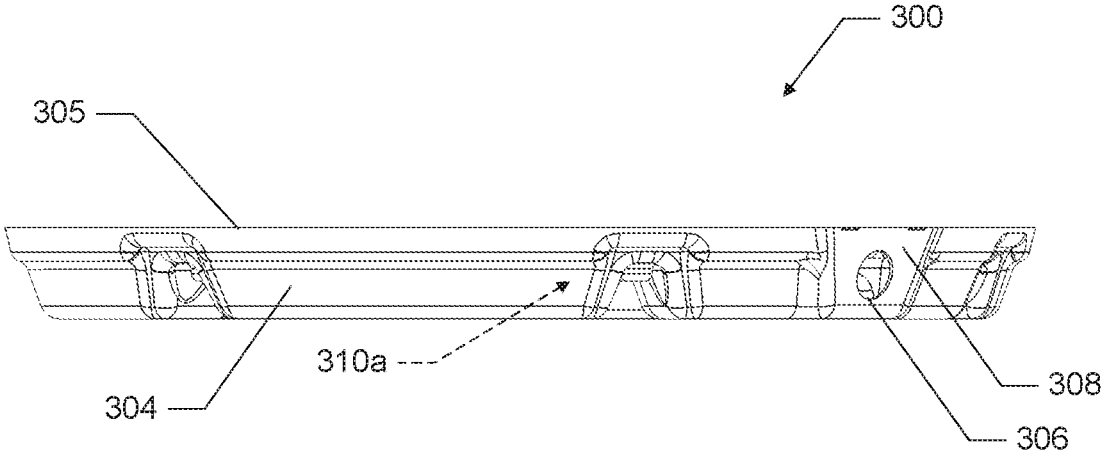
FIG. 22 illustrates a right side view of a water heater pan, according to an example implementation of the present disclosure.
Figure 23:
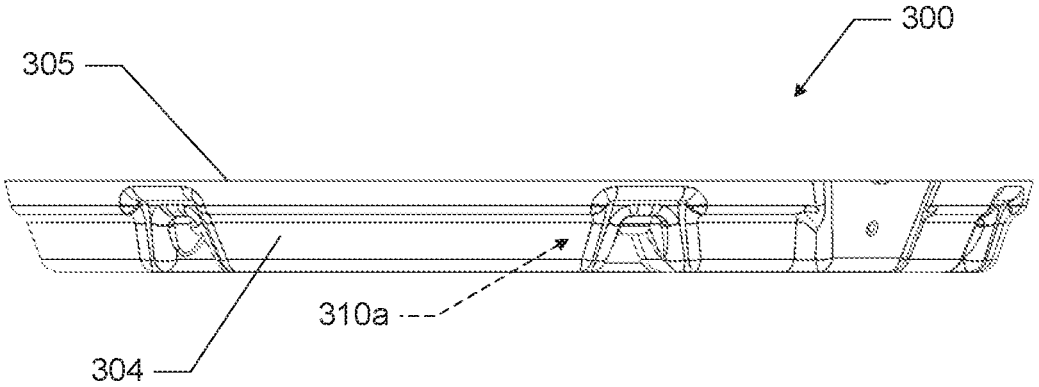
FIG. 23 illustrates a left side view of a water heater pan, according to an example implementation of the present disclosure.
Figure 24:
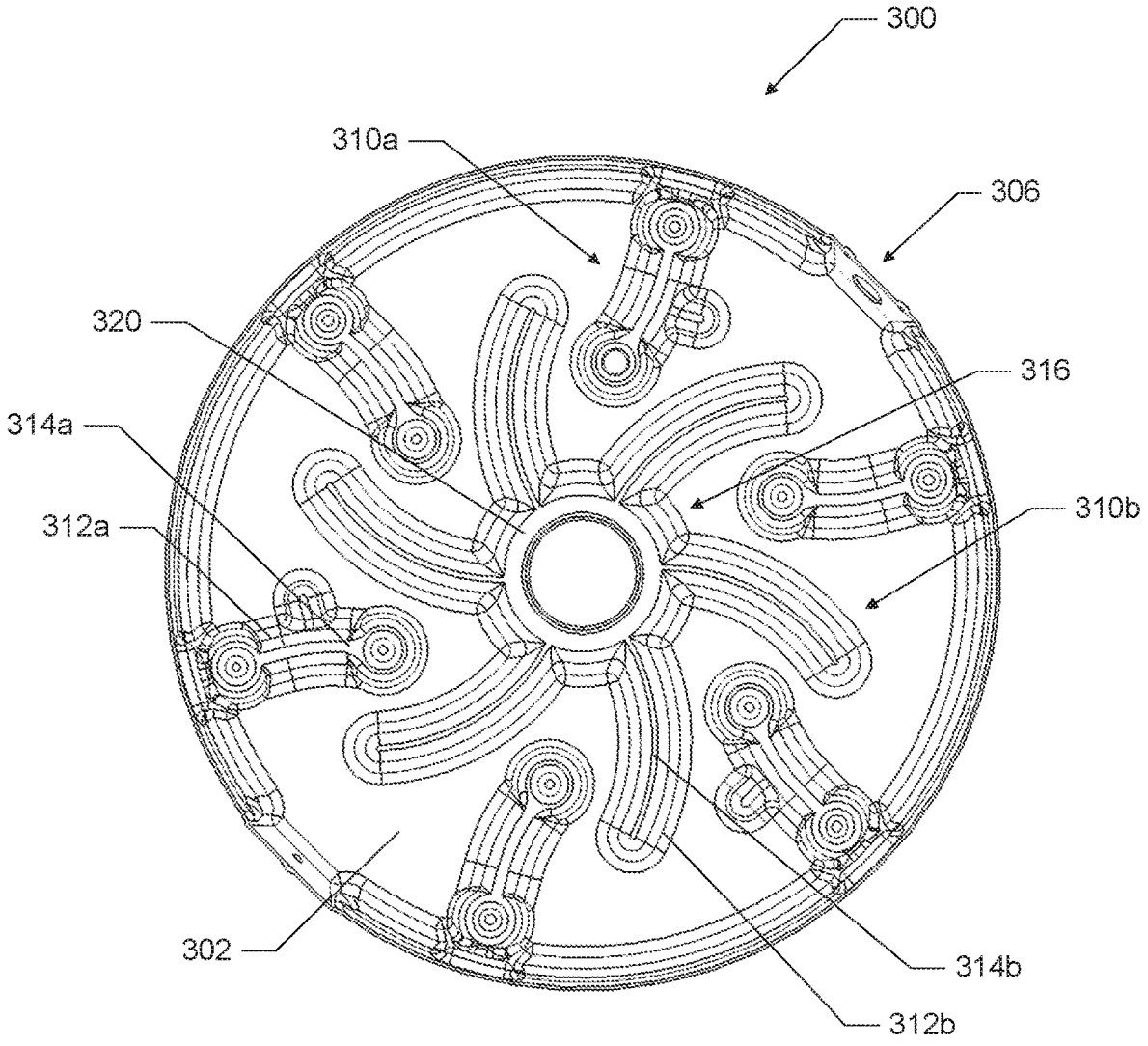
FIG. 24 illustrates a top view of a water heater pan, according to an example implementation of the present disclosure.
Figure 25:
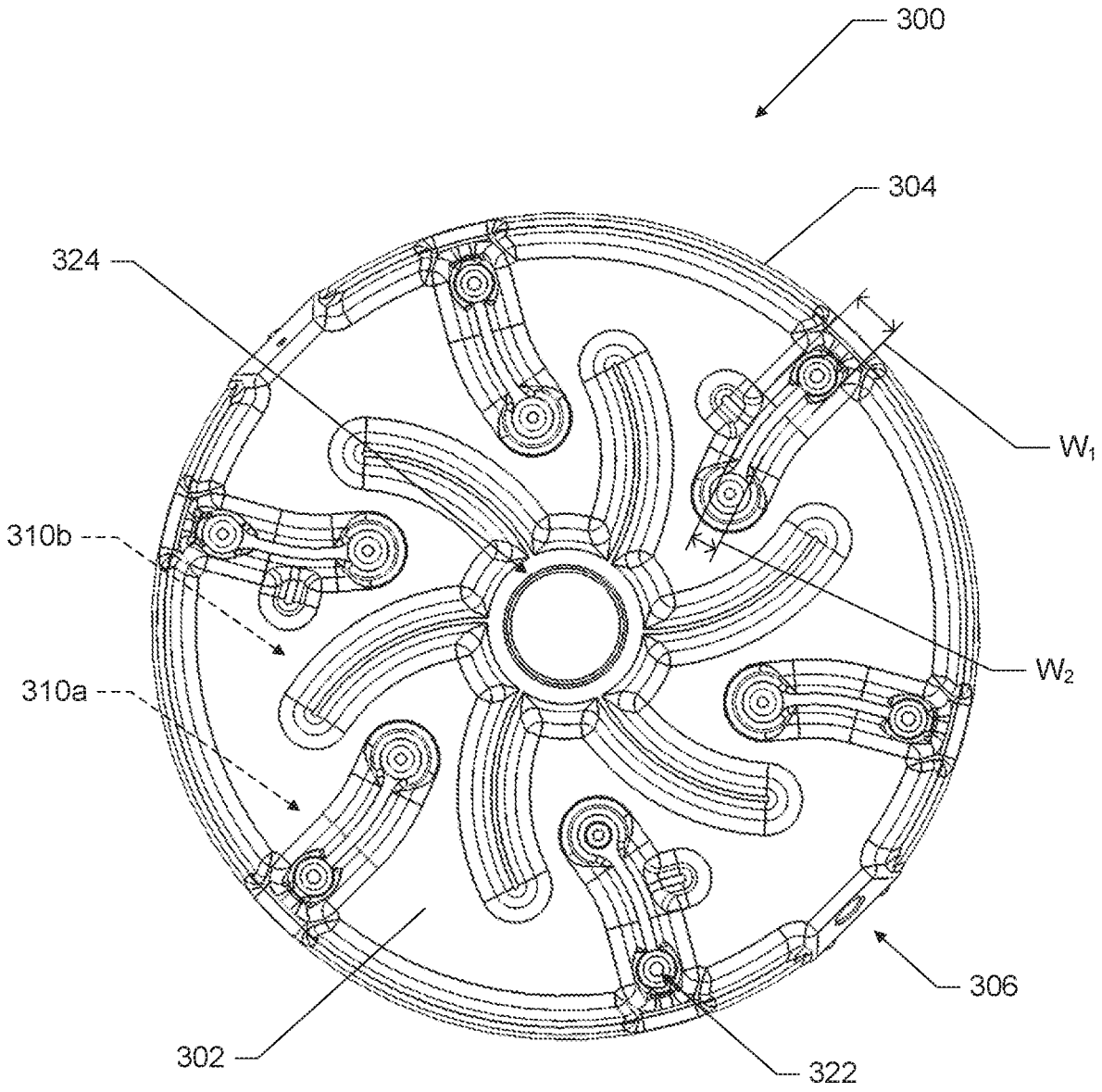
FIG. 25 illustrates a bottom view of a water heater pan, according to an example implementation of the present disclosure.
Figure 26:
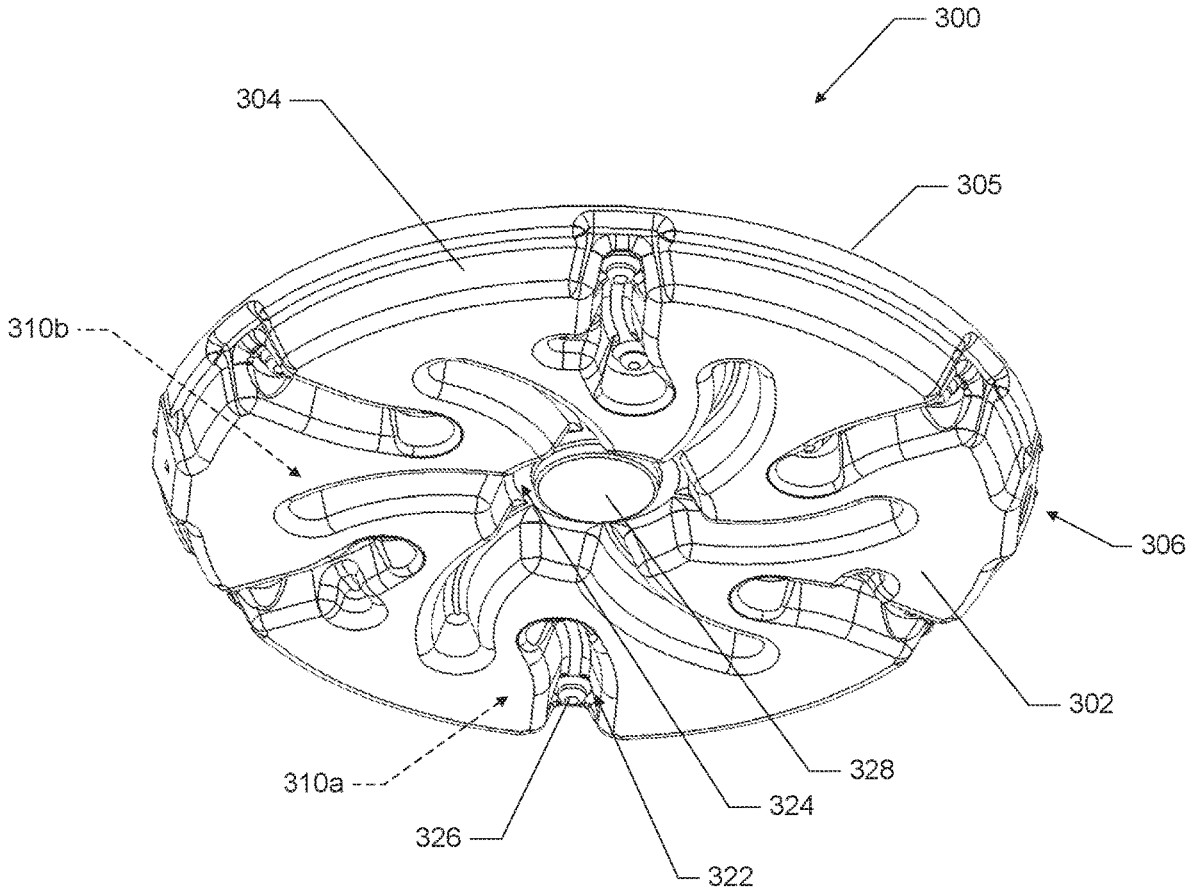
FIG. 26 illustrates a reverse perspective view of a water heater pan, according to an example implementation of the present disclosure.

FIGS. 19-26 illustrate another implementation of the present disclosure. In particular, FIG. 19 of the present disclosure illustrates a perspective view of a water heater pan 300, according to an example implementation of the present disclosure; FIG. 20 illustrates a front view of the water heater pan 300; FIG. 21 illustrates a rear view of the water heater pan 300; FIG. 22 illustrates a right side view of the water heater pan 300; FIG. 23 illustrates a left side view of the water heater pan 300; FIG. 24 illustrates a top view of the water heater pan 300; FIG. 25 illustrates a bottom view of the water heater pan 300; and FIG. 26 illustrates a reverse perspective view of a water heater pan.

With reference to the figures, the water heater pan 300 of the depicted implementation includes a bottom wall 302 and an outer wall 304 extending upwardly from, and substantially surrounding, the bottom wall 302. In the depicted implementation, the outer wall 304 extends upwardly from the bottom wall 302 at an obtuse angle with respect thereto. In various implementations, such a configuration may be helpful for stacking multiple water heater pans when not in use, and/or to facilitate manufacturing the pan, such as for implementations in which the pan is a unitary molded part. In other implementations, the outer wall may extend upwardly at an approximately 90 degree angle with respect to the bottom wall, or, in still other implementations, at an acute angle with respect to the bottom wall. Although not necessary in all implementations, the outer wall 304 of the depicted implementation also includes a flared lip 305 at a distal end of the outer wall 304 and extending substantially around the perimeter thereof.

In the depicted implementation, the water heater pan 300 is made of a moldable plastic material, such as, but not limited to, polycarbonate, polyethylene, acrylonitrile butadiene styrene (ABS), polyamide (Nylon), or polypropylene. Other materials are also possible, including, for example, other plastic materials such as acrylic, or metal materials such as, but not limited to, steel, aluminum, or cooper. Combinations of materials are also possible.

The outer wall also includes drain opening 306, which is defined at a location along the perimeter of the outer wall 304, and which may be configured for attachment of a hose or other conduit for draining any water contained in the pan 300. Although in the depicted implementation the drain opening 306 is substantially circular in shape and is defined in an extended area 308 of the outer wall 304, in other implementations the drain opening may have other configurations.

In various implementations, the water heater pan of the present disclosure may include at least one elevated support feature configured to position the bottom of a hot water storage tank above the surface of the bottom wall of the pan. In such a manner, the water heater pan of the present disclosure may provide additional volume for water to accumulate that would otherwise be taken up by the bottom of a hot water storage tank. In the depicted implementation, the water heater pan 300 includes a plurality of elevated support features 310*a*, 310*b*, which are configured to support the bottom of a hot water storage tank. Although elevated support features of various implementations may have any shape, in the depicted implementation the elevated support features 310*a*, 31*b* comprise arcuate structures. In particular, the depicted implementation includes first elevated support features 310*a*, which extend radially from the outer wall 304 toward a center portion of the bottom wall 302, and second elevated support features 310*b*, which extend radially from a center elevated support feature 316 toward the outer wall 304 and in between the first elevated support features 310*a*.

Although in other implementations the elevated support features may have other arrangements, in the depicted implementation the first elevated support features 310*a* intersect the outer wall 304 on one end, with each of the first elevated support features 310 comprising a pair of side walls 312*a* and a top wall 314*a* extending therebetween. Likewise, the second elevated support features 310*b* comprise a pair of side walls 312*b* and a top wall 314*b* extending therebetween. The side walls 312*a*, 312*b* of the depicted implementation extend upwardly from the bottom wall 302 at an obtuse angle with respect to the bottom wall 302. In various implementations, such a configuration may be helpful for stacking multiple water heater pans when not in use, and/or to facilitate manufacturing the pan, such as for implementations in which the pan is a unitary molded part. However, in other implementations, the outer wall may extend upwardly at an approximately 90 degree angle with respect to the bottom wall, or, in other implementations, at an acute angle with respect to the bottom wall. In the depicted implementation, the side walls 312*a*, 312*b* of each of the elevated support features 310*a*, 310*b* converge at a front portion thereof. In the depicted implementation, the first elevated support features 310*a* converge before the central elevated support feature 316, the second elevated support features 310*b* converge before the outer wall 304; however, in other implementations the elevated support features may have other configurations. In such a manner, each of the elevated support features 310*a*, 310*b* of the depicted implementation creates a relatively hollow area therein. In the depicted implementation, there are six first elevated support features 310*a*, and six second elevated support features 310*b*; however, in other implementations there may be more or less elevated support features. In the depicted implementation, the elevated support features 310*a*, 310*b* have a height that is slightly larger than half of the overall height of the outer wall 304 of the pan (such as, e.g., $\frac{5}{8}^{th}$ of the overall height of the outer wall); however, in other implementations the elevated support features may have any height, which may be less than, substantially equal to, or greater than the height of the outer wall. Although in the depicted implementation the first elevated support features 310*a* are substantially evenly spaced around the perimeter of the outer wall 304 and the second elevated support features 310*b* are substantially evenly spaced around the perimeter of the center elevated support feature 316, in other implementations the elevated support features need not be evenly spaced and may have an uneven arrangement. Furthermore, although in the depicted implementation the elevated support features 310*a*, 310*b* have a particular shape, including a length, width, and height thereof, in other implementations the elevated support features may have varying shapes, even within the same water heater pan.

As noted above, the depicted implementation of the water heater pan 300 also includes a central elevated support feature 316, which is located in the central portion of the bottom wall 302. In the depicted implementation, the central elevated support feature 316 comprises a side wall 318, which extends upwardly from the bottom wall 302, and top wall 320 that together form a substantially hollow area therein. In the depicted implementation, the side wall 318 extends upwardly from the bottom wall 302 at an obtuse angle with respect to the bottom wall 304. In various implementations, such a configuration may be helpful for stacking multiple water heater pans when not in use, and/or to facilitate manufacturing the pan, such as for implementations in which the pan is a unitary molded part. However, in other implementations, the side wall may extend upwardly at an approximately 90 degree angle with respect to the bottom wall, or, in other implementations, at an acute angle with respect to the bottom wall. Although in the depicted implementation the central elevated support feature 316 has truncated conical overall shape, in other implementations the central elevated support feature may have any shape. It should be noted that some implementations need not include a central elevated support feature. In the depicted implementation, the central elevated support feature 316 has a height that is slightly larger than half of the overall height of the outer wall 304 of the pan (such as, e.g., $\frac{5}{8}^{th}$ of the overall height of the outer wall) and that substantially matches the height of the other elevated support features 310*a*, 310*b*; however, in other implementations the central elevated support feature may have different dimensions.

As described above, hot water storage tanks come in various shapes and sizes. When full, some hot water heater storage tanks weigh in excess of 500 lbs. As such, in addition to the support provided by the elevated support features, the water heater pan of the present disclosure also includes one or more features configured to accommodate one or more supplemental support components. In particular, the water heater pan 300 of the present disclosure includes at least one supplemental support cavity configured to receive a supplemental support component.

FIG. 25 illustrates a bottom view of the water heater pan 300, according to an example implementation of the present disclosure, and FIG. 26 illustrates a reverse perspective view of the water heater pan 300, showing the bottom side thereof. With reference to the figures, at least one of the elevated support features 310 of the water heater pan 100 of the depicted implementation includes a supplemental support cavity 322 configured to receive a supplemental support component. Although in other implementations the elevated support features may include more or less supplemental support cavities, in the depicted implementation each of the first elevated support features 310*a* includes a pair of supplemental support cavities 322. In the case of the depicted implementation, the second elevated support features 310*b* do not include supplemental support cavities; however, in other implementations both the first and second elevated support features may include supplemental support cavities. In other implementations, only the second elevated support features may include supplemental support cavities, and in still other implementations some of the first elevated support features and some of the second elevated support features may include supplemental support cavities.

In the depicted implementation, the supplemental support cavities 322 of the first elevated support features 310*a* are at first and second ends of the length of the elevated support features 310*a*, such that one supplemental support cavity 322 is located proximate the outer wall 304 and the other supplemental support cavity 322 is located proximate a distal end of the elevated support feature 310*a*. It should be noted, however, that in other implementations, the supplemental support cavities may have different locations within the elevated support features and need not be evenly spaced. In the depicted implementation, the central elevated support feature 316 also includes a supplemental support cavity 324.

In the depicted implementation, the supplemental support cavities 322, 324 of the elevated support features 310*a*, 316 have a truncated conical shape configured to receive a tubular shaped supplemental support component (described, for example, above). The supplemental support cavities 322 of the first elevated support features 310*a* of the depicted implementation also have a width ($W_1$) that is larger than a width ($W_2$) defined between the pair of side walls 312*a* of the first elevated support features 310*a*. (Note that in various implementations, $W_1$ and $W_2$ may be measured at various corresponding locations.) In such a manner, the supplemental support features 322 of the first elevated support features 310*a* of the depicted implementation may trap or substantially retain supplemental support components contained therein. It should be noted, however, in other implementations the supplemental support cavities may have any shape and may be configured to receive a supplemental support component having any shape. Moreover, in still other implementations the supplemental support cavities may have different shapes within the same water heater pan.

In addition to the configuration of the supplemental support cavities (as in the case of the depicted implementation) or as alternative thereto (as in the case of other implementations), the elevated support features may further include location protrusions. For example, the elevated support features 310*a*, 316 of the depicted implementation further include corresponding location protrusions 326, 328 that extend downward from the respective top walls 314*a*, 320 thereof. In the depicted implementation, the location protrusions 326, 328 extend downward a distance less than the distance to the bottom of the bottom wall 302; however, in other implementations the location protrusions may extend any distance up to and including the distance to the bottom of the bottom wall. Further, in some implementations the location protrusions may extend different distances, even within the same water heater pan. It should be noted that while not all implementations need include any location protrusions and not all elevated support features need include location protrusions therein, in the depicted implementation there are thirteen location protrusions 326, 328 (twelve location protrusions 326 located in the first elevated support features 310*a* and one location protrusion 328 located in the central elevated support feature 316). These protrusions correspond to the twelve supplemental support cavities 322 defined by the first elevated support features 310*a* and the support cavity 324 defined by the central elevated support feature 316.

Although in some implementations of the present disclosure a water heater pan and one or more supplemental support components may be provided together as a complete hot water heater support system, these components may be provided separately. Accordingly, any discussion otherwise provided herein in relation to the components in combination also should be understood as applying to the water heater pan and the supplemental support components as individual and separate components. In another aspect, the present disclosure may be directed to packages that provide a variety of components as described herein. For example, a package may comprise a water heater pan with one or more supplemental support components. In further implementations, a package may comprise a water heater pan individually or a plurality of supplemental support components.

Many modifications and other implementations of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A hot water storage tank support system comprising:

a water heater pan having a bottom wall, an outer wall extending upwardly from and substantially surrounding the bottom wall, and at least one elevated support feature; and at least one rigid supplemental support component, wherein the at least one elevated support feature is configured to contact the hot water storage tank, wherein the at least one elevated support feature includes at least one supplemental support cavity located underneath the elevated support feature that receives the at least one supplemental support component, wherein the at least one supplemental support component is insertable and removable from the water heater pan, and wherein the at least one supplemental support component has a substantially tubular shape.

2. The hot water storage tank support system of claim 1, wherein the at least one elevated support feature comprises a central elevated support feature located in a central portion of the bottom wall.

3. The hot water storage tank support system of claim 1, wherein the at least one elevated support feature comprises a circumferential elevated support feature spaced inwardly from the outer wall.

4. The hot water storage tank support system of claim 1, wherein the at least one supplemental support cavity comprises a plurality of supplemental support cavities, wherein the at least one supplemental support component comprises a plurality of supplemental support components, and wherein the plurality of supplemental support components are insertable and removable from corresponding ones of the plurality of supplemental support cavities.

5. The hot water storage tank support system of claim 1, wherein the at least one elevated support feature extends inwardly from the outer wall.

6. The hot water storage tank support system of claim 1, wherein the at least one supplemental support component comprises a plurality of supplemental support components, and wherein at least one supplemental support component has a different size than at least one other supplemental support component.

7. The hot water storage tank support system of claim 1, wherein the at least one supplemental support cavity has a first width, wherein the at least one elevated support feature has a second width, and wherein the first width is larger than the second width.

8. The hot water storage tank support system of claim 1, wherein the at least one elevated support feature comprises a pair of side walls and a top wall extending therebetween.

9. The hot water storage tank support system of claim 8, wherein the at least one elevated support feature includes at least one locating protrusion extending downward from the top surface thereof, and wherein the at least one locating protrusion is configured to locate the at least one supplemental support component.

10. A hot water storage tank support system comprising:

a water heater pan having a bottom wall, an outer wall extending upwardly from and substantially surrounding the bottom wall, and at least one elevated support feature; and at least one rigid supplemental support component, wherein the at least one elevated support feature is configured to contact the hot water storage tank, wherein the at least one elevated support feature includes at least one supplemental support cavity located underneath the elevated support feature that receives the at least one supplemental support component, wherein the at least one supplemental support component is insertable and removable from the water heater pan, wherein the at least one supplemental support component comprises a plurality of supplemental support components, and wherein at least one supplemental support component has a different size than at least one other supplemental support component.

* * * * *